US008882240B2

(12) United States Patent
Hirosawa et al.

(10) Patent No.: US 8,882,240 B2
(45) Date of Patent: Nov. 11, 2014

(54) INKJET PRINTING APPARATUS AND PRINT HEAD RECOVERY METHOD

(75) Inventors: Susumu Hirosawa, Tokyo (JP); Hidehiko Kanda, Yokohama (JP); Yutaka Kano, Yokohama (JP); Kentarou Muro, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 13/363,409

(22) Filed: Feb. 1, 2012

(65) Prior Publication Data

US 2012/0206524 A1 Aug. 16, 2012

(30) Foreign Application Priority Data

Feb. 14, 2011 (JP) ..... 2011-028479

(51) Int. Cl.
*B41J 2/165* (2006.01)
*B41J 29/38* (2006.01)
*B41J 11/66* (2006.01)

(52) U.S. Cl.
CPC ..... *B41J 29/38* (2013.01); *B41J 2/1652* (2013.01); *B41J 11/66* (2013.01); *B41J 2/16547* (2013.01)
USPC ..... 347/23; 347/19; 347/22; 347/29; 347/30; 347/35

(58) Field of Classification Search
CPC ..... B41J 2/165; B41J 2/1652; B41J 11/66; B41J 29/38
USPC ..... 347/14, 23
See application file for complete search history.

(56) References Cited

U.S. PATENT DOCUMENTS 5,565,898 A * 10/1996 Sakuma ..... 347/23
6,193,351 B1 2/2001 Yaegashi et al.

(Continued)

FOREIGN PATENT DOCUMENTS

CN 1059120 A 2/1991
CN 1476983 A 2/2004

(Continued)

OTHER PUBLICATIONS

English machine translation of JP 11-249346, retrieved Jul. 5, 2012.*

(Continued)

*Primary Examiner* — Manish S Shah
*Assistant Examiner* — Jeffrey C Morgan
(74) *Attorney, Agent, or Firm* — Fitzpatrick, Cella, Harper & Scinto

(57) ABSTRACT

An inkjet printing apparatus and a print head recovery method are provided according to which, in an environment in which dust (e.g., paper dust) is easily attached to the periphery of an ejection port of a print head, the print head is subjected to a recovery operation depending on the level of the attached dust. The inkjet printing apparatus has a cutter unit for cutting a print medium and a recovery unit for performing the recovery operation by wiping the ejection port formation portion at which the ejection port is formed of the print head while sucking the ejection port formation portion. When the passing number showing how many times the cut part of the print medium cut by the cutter passes the printing position is equal to or higher than a threshold value, the recovery means subjects the print head to the recovery operation.

14 Claims, 13 Drawing Sheets

(56) References Cited

U.S. PATENT DOCUMENTS

| | | | | |
|---|---|---|---|---|
| 6,382,765 | B1 | 5/2002 | Kanda et al. | |
| 6,447,095 | B1 | 9/2002 | Kanda et al. | |
| 6,854,826 | B2 | 2/2005 | Kanda et al. | |
| 6,896,351 | B1 | 5/2005 | Satake | |
| 7,118,190 | B2 | 10/2006 | Sakamoto et al. | |
| 8,033,636 | B2 | 10/2011 | Inoue | |
| 8,113,642 | B2 | 2/2012 | Akiyama et al. | |
| 2003/0160855 | A1* | 8/2003 | Nakasendo | 347/116 |
| 2004/0114019 | A1 | 6/2004 | Nakashima | |
| 2007/0273899 | A1* | 11/2007 | Yazawa et al. | 358/1.8 |
| 2008/0055357 | A1 | 3/2008 | Hamasaki et al. | |
| 2008/0165219 | A1 | 7/2008 | Inoue | |
| 2009/0135226 | A1 | 5/2009 | Sakamoto et al. | |
| 2009/0244161 | A1 | 10/2009 | Yamamoto et al. | |
| 2011/0134185 | A1 | 6/2011 | Yamamoto et al. | |
| 2011/0148965 | A1 | 6/2011 | Taira et al. | |

FOREIGN PATENT DOCUMENTS

| | | | | |
|---|---|---|---|---|
| CN | 1477595 | A | | 2/2004 |
| CN | 1715055 | A | | 1/2006 |
| JP | 11-249346 | | * | 9/1999 |
| JP | 11-249346 | A | | 9/1999 |
| JP | 2000-289229 | A | | 10/2000 |
| JP | 2011-011489 | A | | 1/2011 |

OTHER PUBLICATIONS

Office Action in Chinese Application No. 201210033187.6, issued Jan. 30, 2014, with English translation (24 pages).

* cited by examiner

| ACCUMULATED CUT NUMBER | PASSING NUMBER FOR PRINTING POSITION |
|---|---|
| 0 ～ 10000 | 100 |
| 10000 ～ 50000 | 50 |
| 50000 ～ 200000 | 30 |
| 200000 ～ | 10 |

FIG.12

INKJET PRINTING APPARATUS AND PRINT HEAD RECOVERY METHOD

BACKGROUND OF THE INVENTION

1. Field of the Invention

The present invention relates to an inkjet printing apparatus in which a recovery operation is performed in a print head for ejecting ink and a method of recovering a print head in the inkjet printing apparatus.

2. Description of the Related Art

It has been known that, in an inkjet printing-type printing apparatus, the recovery operation by a cleaning means has been performed in order to suppress the deterioration of the quality of a printed image while maintaining a favorable ink ejection through an ejection port in a print head. As an inkjet printing apparatus in which recovery operation is performed by the cleaning means, there is the one in which time is measured under fixed conditions to perform cleaning based on the measured time. The time to be measured includes, as disclosed in Japanese Laid-Open Publication No. 2000-289229 for example, the accumulated printing time during which the printing is performed while the print head being not capped, the elapsed time since the previous recovery operation, and the capping time during which the capping is continuously performed after the completion of the printing for example. Based on these measured times, a table is referred to adjust the recovery operation level. By performing the recovery operation as described above, a printing apparatus is configured so as to suppress an excessive recovery operation to prevent a burden on a user.

By performing the recovery operation at the timing as described above, it is possible to suppress ink having an increased viscosity due to water evaporation in the ink from an ejection port of the print head. However, in case that the inkjet printing apparatus is in an environment in which dust such as paper dust is easily attached to an ejection port in the print head, the inkjet printing apparatus cannot solve such problem. Thus, it may be insufficient to perform the recovery operation as described above in which the time is measured under fixed conditions to perform the recovery operation based on the measured time.

SUMMARY OF THE INVENTION

In view of the above situation, it is an objective of the present invention to provide an inkjet printing apparatus according to which, when the inkjet printing apparatus is in an environment in which dust such as paper dust is easily attached to an ejection port in a print head, the print head is subjected to a recovery operation depending on the level of the attached dust and the recovery method thereof.

According to an aspect of the present invention, there is provided an inkjet printing apparatus, comprising: a print head that can eject ink; a conveying unit for conveying print medium along a conveying path passing a printing position at which printing can be performed on a print medium by the print head; a cutter that can cut the print medium; a recovery unit for performing a recovery operation of the print head; and a control unit for controlling the recovery operation performed by the recovery unit based on a passing number which is number of times through which a cut part of the print medium cut by the cutter passes the printing position.

According to an aspect of the present invention, there is provided a print head recovery method in an inkjet printing apparatus including a print head through which ink can be ejected and a recovery unit for performing a recovery operation of the print head, comprising: a step of conveying a print medium along a conveying path passing a printing position at which printing can be performed on print medium by the print head; a step of cutting the print medium by a cutter; and a step of controlling the recovery operation performed by the recovery unit based on a passing number which is number of times through which a cut part of print medium cut by the cutter passes the printing position.

According to the present invention, the print head can be subjected to a recovery operation at a timing depending on an ease of adherence of dust (e.g., paper dust) to the periphery of the ejection port in the print head. Thus, the ink ejection can be suppressed from being influenced by the attached dust (e.g., paper dust). This can consequently maintain the high quality of a printed image printed by the inkjet printing apparatus.

Further features of the present invention will become apparent from the following description of exemplary embodiments (with reference to the attached drawings).

BRIEF DESCRIPTION OF THE DRAWINGS

FIG. 12 is a table that is used when the timing at which the print head recovery operation is controlled based on the flow of FIG. 11 and that shows a relation between the accumulated cut number and the passing number of the printing position as a threshold value.

DESCRIPTION OF THE EMBODIMENTS

The following portion will describe an embodiment of the present invention with reference to the attached drawings.

(First Embodiment)

Figure 1:
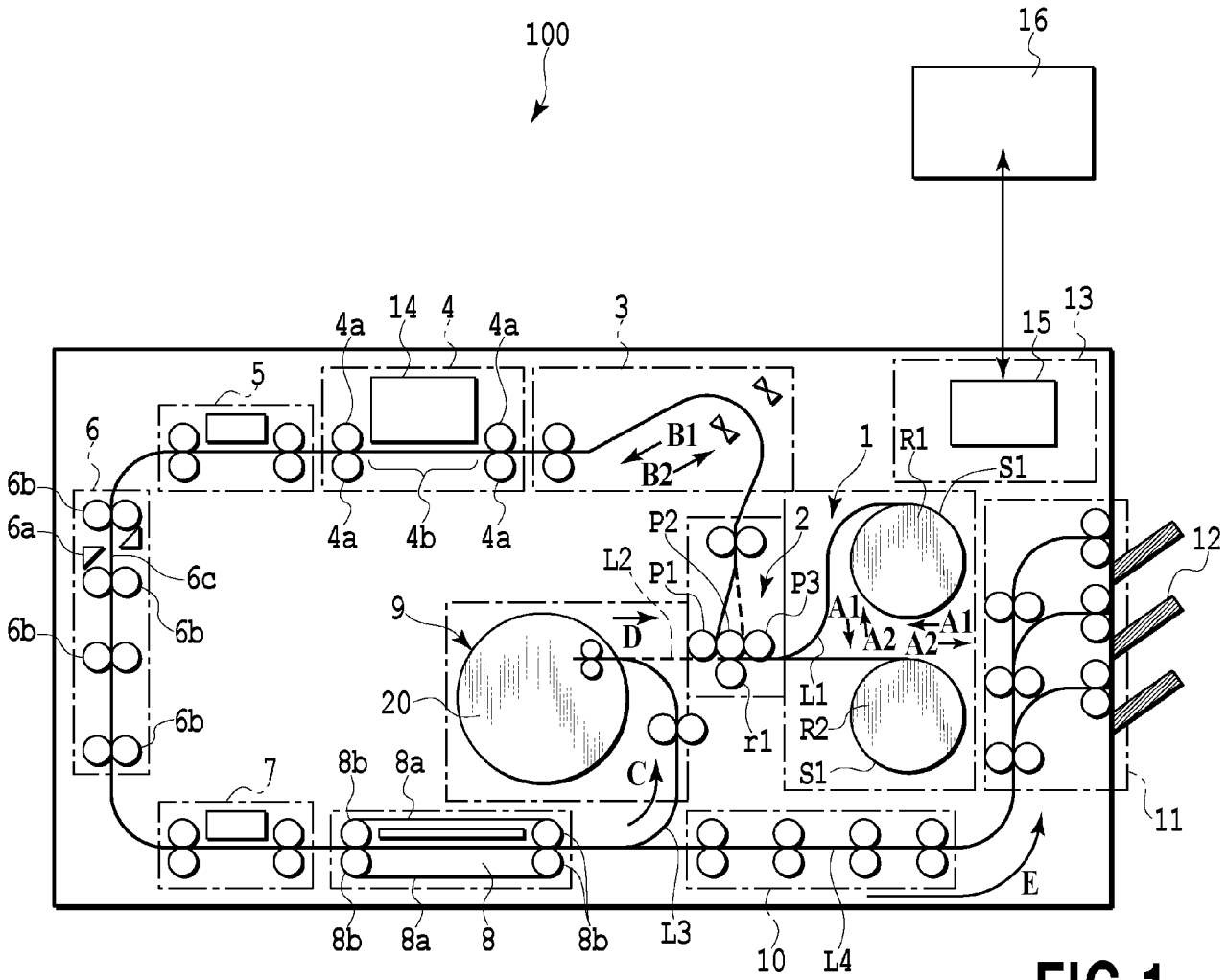
FIG. 1 is a cross-sectional view schematically illustrating the internal configuration of an inkjet printing apparatus according to the first embodiment of the present invention.

An inkjet printing apparatus of this embodiment, in which a continuous sheet functioning as a print medium and winded to have a roll-like shape is used, is an illustrative high-speed line printer and that can provide both of the one-side printing and the double-side printing. For example, the inkjet printing apparatus is suitable for an application where a large amount of printing is required in a printing factory for example. FIG. 1 is a cross-sectional view schematically illustrating the internal configuration of an inkjet printing apparatus 100. The inkjet printing apparatus 100 includes the respective units of: a sheet supply portion 1; a decal portion 2; a positional deviation correction portion 3; a printing portion 4; an inspection portion 5; a cutter portion 6; an information printing portion 7; a drying portion 8; a sheet winder 9; a discharge conveying portion 10; a sorter portion 11; a discharge tray 12; and a control portion 13. A sheet is conveyed by a conveying unit composed of a pair of rollers and a belt along a sheet conveying path (which will be described later) and is subjected to the processings by the respective units. In this embodiment, the sheet is a roll paper. The roll paper is provided while being winded at a roll position and one end thereof is conveyed in the directions A1 and B1.

The sheet supply portion 1 is a unit that stores therein a roll paper of a continuous sheet winded in a roll-like manner and that supplies one end of the sheet to the printing portion 4. The sheet supply portion 1 is configured so as to be able to store therein two roll papers R1 and R2. The sheet supply portion 1 is configured to selectively draw one of the two roll papers R1 and R2 in the direction shown by the arrow A1 to supply the sheet to a downstream printing position. The number of roll papers that can be stored in the sheet supply portion 1 is not limited to two. Thus, one roll paper or three or more roll papers also can be stored therein. The decal portion 2 is a unit to reduce the curl (warpage) of the sheet supplied from the sheet supply portion 1. The decal portion 2 is configured so that the respective sheet paths L1 and L2 (which will be described later) have two pinch rollers P1 and P2 and two pinch rollers P2 and P3 corresponding to one driving roller r1 that are used to apply, to the sheet, an opposite warpage to the curling direction of the curl of the sheet. In this manner, the sheet is curved to correct the curl of the sheet. By drawing the sheet between the rollers for correction, the curl of the sheet is reduced. The sheet having passed through the decal portion 2 is conveyed in the direction shown by the arrow B1. The positional deviation correction portion 3 is a unit that corrects the positional deviation of the sheet having passed through the decal portion 2 (an inclination to an intended direction along which the sheet should proceed). By pressing one of sheet end, which is used as a reference, to a guide member, the positional deviation of the sheet is corrected.

The printing portion 4 is a unit that forms an image on the sheet by ejecting ink from a print head 14 to the sheet conveyed in the direction shown by the arrow B1. The printing portion 4 also includes a plurality of conveying rollers 4*a* for conveying a sheet. The printing portion 4 has the print head 14 for ejecting ink through an ejection port. The print head 14 includes a plurality of ejection ports through which ink can be ejected. The plurality of ejection ports constitute an ejection port array. The ejection port array is formed in a direction crossing the direction along which a sheet is conveyed (the direction orthogonal to the sheet-conveying direction in the case of this example). The print head 14 of this embodiment is a line-type print head in which inkjet-type ejection port arrays are formed so as to cover the maximum width of a sheet to be used. The print head 14 is configured so that a plurality of chips are arranged to be parallel to one another in the conveying direction of the sheet. In this example, the print head 14 includes seven print heads corresponding to cyan (C), magenta (M), yellow (Y), light cyan (LC), light magenta (LM), gray (G), and black (K). The number of color (s) and the number of the print heads are not limited to seven. The inkjet method may be, for example, a method using an electrothermal transducing element (heater), a method using a piezoelectric element, a method using an electrostatic element, or a method using an MEMS element for example. When a heater is used, the heat generated from the heater is used to foam ink so that the foaming energy thereof can be used to eject ink through an ejection port. The inks of the respective colors are supplied from ink tanks via ink tubes to the print head 14.

The inspection portion 5 is a unit that optically reads an inspection pattern or an image printed on a sheet by the printing portion 4 to inspect the state of the ejection port of the print head, the sheet conveying state, or the image position for example. The cutter portion (cutter unit) 6 is a unit that includes a cutter 6*a* for cutting a sheet so that the sheet as a print medium having been printed can be cut to have a predetermined length. The cutter 6*a* is provided at a cutting operation position 6*c* along the sheet conveying path. The cutter portion 6 also includes a plurality of conveying rollers 6*b* for sending the sheet to the next step. The information printing portion 7 is a unit that prints, on the reverse-side of the cut sheet, print information (e.g., a print serial number, date). The drying portion 8 is a unit that heats the sheet printed by the printing portion 4 and cut to dry the applied ink within a short time. The drying portion 8 includes, in order to send the sheet to the next step, a conveying belt 8*a* that is winded around the conveying roller 8*b*. In this embodiment, the cutter portion 6 is provided at the downstream-side of the direction shown by the arrow B1 than the printing position 4*b* so as to be able to cut a part of the roll paper positioned at the downstream-side of the direction shown by the arrow B1 than printing position 4*b*.

The sheet winder 9 is a unit that temporarily winds, prior to the double-side printing, the sheet already subjected to a top-side printing. The sheet winder (inversion portion) 9 includes a winding drum 20 that is rotated in order to wind the sheet. The double-side printing is carried out in the manner described as below. Specifically, images corresponding to a predetermined number of cut sheets are printed on the top face of the sheet (top-side printing). Then, the cutter portion 6 cuts a rear end of a printing region of the images corresponding to the predetermined number of cut sheets. The sheet having a length of the predetermined number of cut sheets is a continuous sheet that is not yet cut to the individual cut sheets (which may be also referred to as "continuous sheet"). This continuous sheet is conveyed along the conveying path L3 in the direction shown by the arrow C and is temporarily winded by the winding drum 20. After the continuous sheet is winded around the winding drum 20, the winding drum 20 is rotated in an opposite direction and the continuous sheet is conveyed along the conveying path L2 in the direction shown by the arrow D. Then, the sheet is supplied to the decal portion 2 and is sent again to the printing portion 4. At this point of time, the top and reverse sides of the continuous sheet are inverted. Thus, the reverse-side of the sheet can be printed by the printing portion 4. A more specific operation for the double-side printing will be described later. As described above, the inkjet printing apparatus 100 has the sheet winder 9 that functions to switch the top face and the reverse face of the continuous sheet so that reverse-side can be printed.

The discharge conveying portion 10 is a unit that conveys the printed cut sheet along the conveying path L4 in the direction shown by the arrow E to the sorter portion 11. The sorter portion 11 is a unit that sorts, as required, the printed cut sheet into a different discharge tray 12 based on a group to discharge the sheet, and discharges the sheet. The control portion 13 is a unit that controls the respective parts of the entire printing apparatus. The control portion 13 has a controller 15 including a CPU, a memory, and various I/O interfaces as well as a power source. The operation of the printing apparatus is controlled based on an instruction from an external machine 16 (e.g., a host computer) that is connected to the controller 15 or that is connected to the controller 15 via an I/O interface.

Next, the following section will describe the operation of inkjet printing apparatus during a printing operation. The inkjet printing apparatus 100 of this embodiment can perform a one-side printing for printing only one side of a roll paper and a double-side printing for printing both of the top face and the reverse face of a roll paper. Since the one-side printing and the double-side printing require different sheet paths and different operations of the inkjet printing apparatus, the following section will describe the printing operations of the one-side printing and the double-side printing, respectively.

Figure 2:
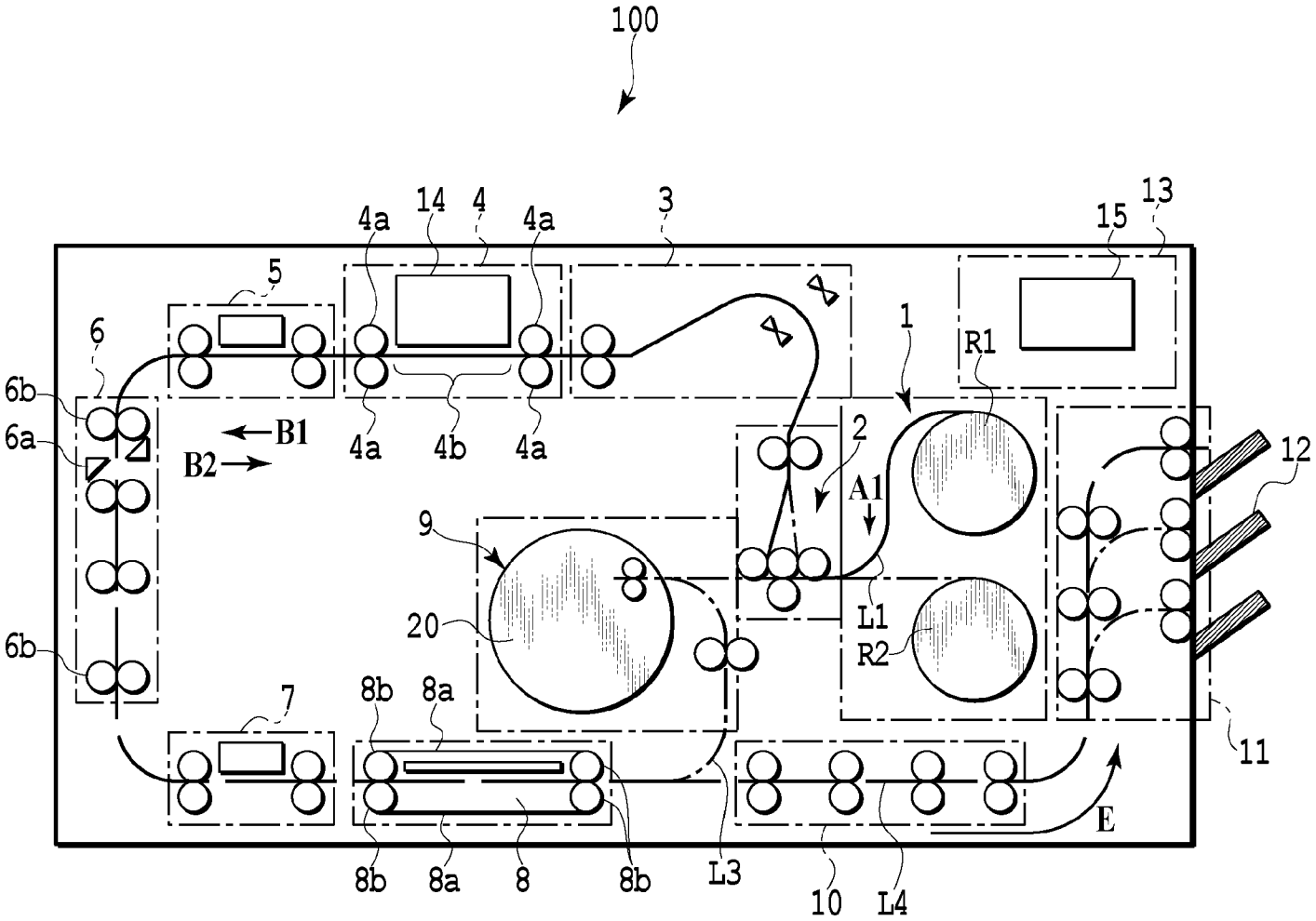
FIG. 2 is a cross-sectional view schematically illustrating a sheet conveying path that is used in the one-side printing by the inkjet printing apparatus of FIG. 1.

FIG. 2 illustrates the operation of the inkjet printing apparatus for the one-side printing. FIG. 2 shows a sheet conveying path along which the sheet supplied from the sheet supply portion 1 is printed and is discharged to the discharge tray 12. The sheet is supplied from the sheet supply portion 1 through the conveying path L1 and is subsequently subjected to the processings by the decal portion 2 and the positional deviation correction portion 3, respectively. Then, the sheet is conveyed in the direction shown by the arrow B1. Then, the top face of the sheet is printed by the printing portion 4. The printed sheet is sent through the inspection portion 5 to the cutter portion 6 through which the sheet is cut to the individual cut sheets having a predetermined unit length. As required, printing information is printed on the reverse sides of the cut sheets by the information printing portion 7. Then, the printed cut sheets are individually conveyed to the drying portion 8 and are dried. Thereafter, the cut sheets are sent via the discharge conveying portion 10 and are conveyed along the conveying path L4 in the direction shown by the arrow E. Then, the cut sheets are sequentially discharged and accumulated into the trays 12 of the sorter portion 11.

Figure 3:
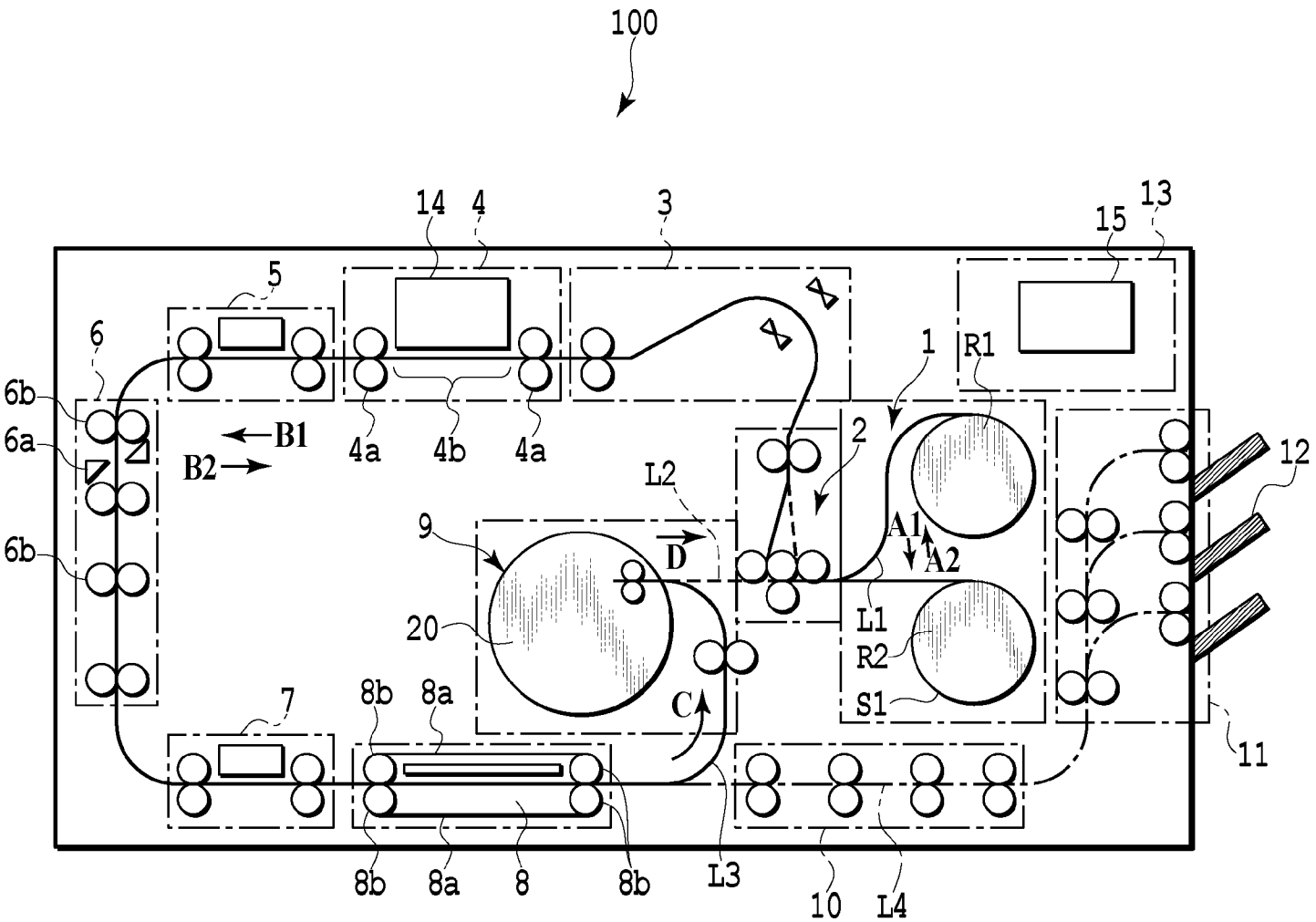
FIG. 3 is a cross-sectional view schematically illustrating the sheet conveying path that is used in the double-side printing by the inkjet printing apparatus of FIG. 1.

FIG. 3 illustrates the double-side printing operation. FIG. 3 shows the sheet conveying path for the double-side printing. The sheet supplied from the sheet supply portion 1 is continuously printed on the top face of the sheet with images corresponding to the predetermined number of cut sheets. After the images corresponding to the predetermined number of cut sheets are continuously printed on the top face of the sheet, the cutter portion 6 cuts a rear end of the printing region of the images corresponding to the predetermined number of cut sheets. Specifically, at the point of time at which the printing on the top face is completed, the cutter portion 6 does not cut the sheet to individual cut sheets but instead cuts sheet to a continuous sheet having a length corresponding to the predetermined number of cut sheets. The continuous sheet is once conveyed along the conveying path L3 and is then winded by the winding drum 20.

The tip end of the continuous sheet is winded around the winding drum 20. Then, the rear end of the sheet is returned along the conveying path L2 to the decal portion 2. As a result, the continuous sheet whose top face is printed with the images is inverted to have inverted top and reverse sides. Then, the inverted sheet is subjected to the processings by the decal portion 2 and the positional deviation correction portion 3. Then, the sheet is subjected to a reverse-side printing by the printing portion 4. In this manner, the continuous sheet is subjected firstly to a top-side printing sequence and secondly to a reverse-side printing sequence. During the reverse-side printing, in order to receive again the continuous sheet whose top face is already printed, no sheet should exist along the sheet conveying path from the decal portion 2 to the cutter portion 6. Thus, the sheet cut from the continuous sheet and left on the inspection portion 5, the printing portion 4, the positional deviation correction portion 3, and the decal portion 2 is rewinded to the sheet supply portion 1 via the conveying path L1 along the direction shown by the arrow B2 and the direction shown by the arrow A2 (returning operation).

As described above, the inkjet printing apparatus 100 of this embodiment can provide the supply operation in which the sheet is supplied by the conveying unit from the sheet supply portion 1 via the printing position 4*b* to the cutting operation position 6*c*. The inkjet printing apparatus 100 of this embodiment also can provide the returning operation in which a part of the sheet positioned between the cutting operation position 6*c* and the sheet supply portion 1 is returned to the sheet supply portion 1.

The continuous sheet to which the ink drying operation of the ink on the top surface of the sheet have been subjected by the drying portion 8 is supplied not to the conveying path L4 of the discharge conveying portion 10 but to the conveying path L3 of the sheet winder 9. The tip end of the continuous sheet supplied to the sheet winder 9 is winded along the conveying path L3 around the winding drum 20 rotating in the forward direction (the counterclockwise direction in the drawing). Then, the entire continuous sheet including the rear end is winded around the sheet winder 9.

Thereafter, the winding drum 20 of the sheet winder 9 is rotated in a reverse direction to the direction along which the continuous sheet was winded (the clockwise direction in the drawing). The rear end of the winded continuous sheet (which is the tip end when the sheet is fed) is sent along the conveying path L2 into the decal portion 2. The decal portion 2 subjects the sheet to the curl correction in a reverse direction to that in the top-side printing. The reason is that the continuous sheet is winded around the winding drum 20 while the top side and the reverse side are inverted when compared with the roll in the sheet supply portion 1 and thus is curled in a reverse direction. Thereafter, the continuous sheet is sent via the positional deviation correction portion 3 to the printing portion 4 where the reverse side of the continuous sheet is printed. Then, the reverse-side-printed continuous sheet is conveyed via the inspection portion 5 to the cutter portion 6. Then, the continuous sheet is cut by the cutter portion 6 to individual sheets sized as a final printed having a predetermined unit length. Since the double sides of the cut sheets are already printed, no printing is performed by the information printing portion 7. Then, the individual cut sheets are conveyed to the drying portion 8 one by one and are sequentially discharged via the discharge conveying portion 10 to the tray 12 in the sorter portion 11 and are accumulated in the tray 12.

In this embodiment, the cutter portion 6 is provided at the downstream-side of the direction shown by the arrow B1 than the printing position at which the print medium is printed by the print head. As described above, the sheet supply portion 1 rewinds any sheet left in the inspection portion 5, the printing portion 4, the positional deviation correction portion 3, and the decal portion 2 as a result of the cutting operation of the continuous sheet in the double-side printing operation. Similarly, the sheet after the completion of a series of one-side printing operations, cutting, and left in the inspection portion 5, the printing portion 4, the positional deviation correction portion 3, and the decal portion 2 can be rewinded to the sheet supply portion 1. The rewinding operation as described above is carried out by returning the cut part at the tip end of the roll paper cut by the cutter portion via the printing position 4*b* in the direction shown by the arrow B2 to the roll position. As described above, the cut part at the tip end of the roll paper is returned to the roll position S1. Thus, the subsequent one-side printing and double-side printing can be performed by effectively using a region close to the tip end of the roll paper for the printing operation. This can consequently prevent a situation where a part close to the tip end of the roll paper is not used for printing and thus is consumed wastefully, thus increasing a part of the roll paper that can be used for printing. Thus, the roll paper can be used more effectively and thus the consumption amount of the roll paper can be suppressed, thus minimizing the operation cost of the inkjet printing apparatus. Furthermore, the above configuration also can reduce a part of the roll paper that is wastefully discharged, thus providing an environmentally-friendly inkjet printing apparatus. If the tip end of the roll paper is not rewinded to the roll position, the tip end-side part of the roll paper closer to the tip end in the direction shown by the arrow B1 than the printing position 4*b* will be conveyed to the downstream-side without being printed at the printing position 4*b*. Thus, the tip end-side part of the roll paper is discharged to the outside of the printing apparatus without being used for the printing operation, thus proportionally causing the wasteful consumption of the roll paper.

In this embodiment, the cut part at the tip end of the roll paper cut by the cutter portion 6 is returned via the printing position 4*b* to the roll position S1. However, the present invention is not limited to this. Specifically, the cut part at the tip end of the roll paper cut by the cutter portion 6 does not have to be returned to the roll position S1 so long as the cut part is conveyed to a position closer to the direction shown by the arrow B2 (upstream-side) than the printing position 4*b* at which ink is ejected through the print head. Alternatively, the sheet cut by the cutter portion 6 and left on the inspection portion 5, the printing portion 4, the positional deviation correction portion 3, and the decal portion 2 may be returned to a position between the roll position S1 and the printing position 4*b*.

Figure 4:
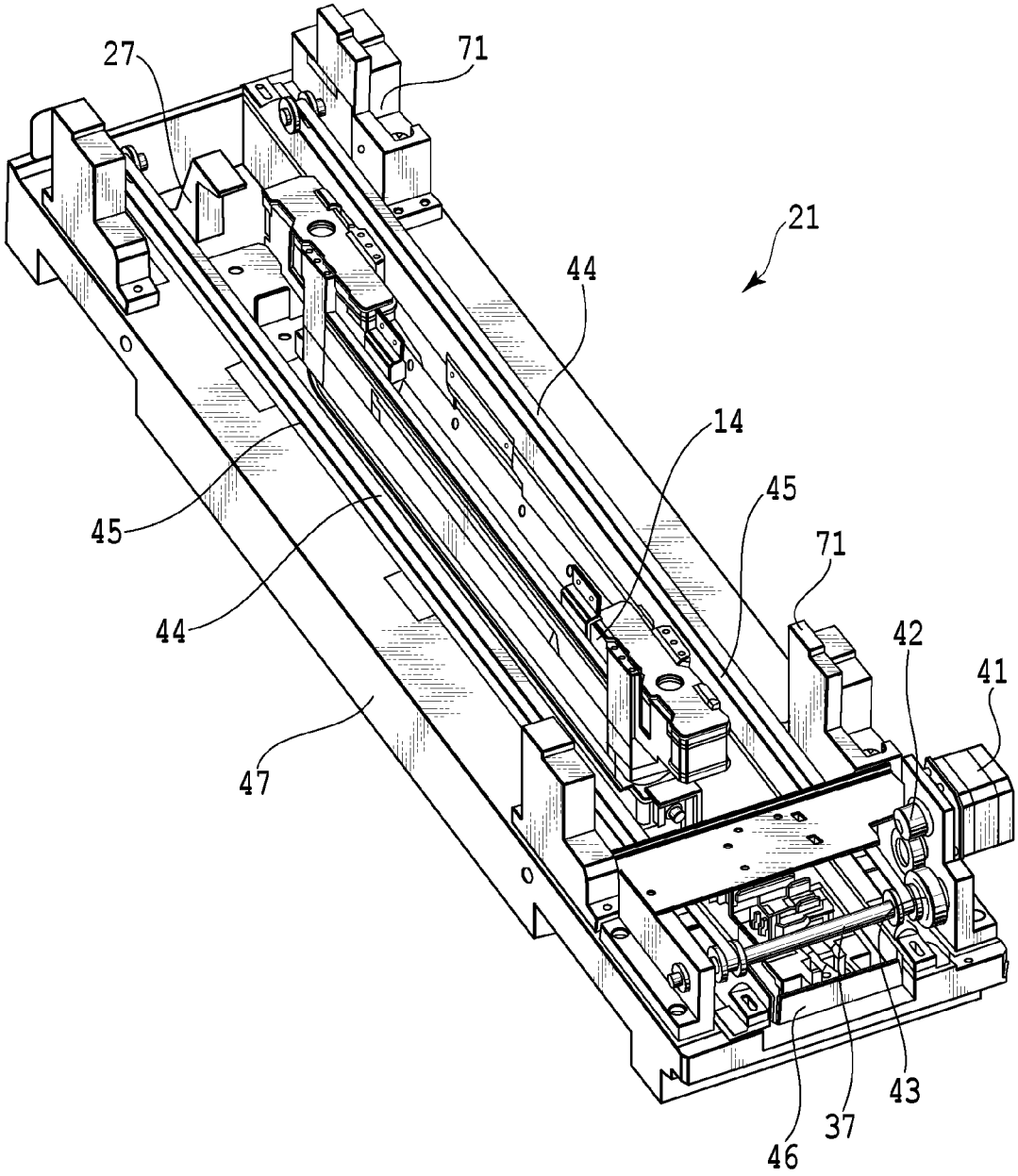
FIG. 4 is a perspective view illustrating a cleaning mechanism that performs the recovery operation of the print head of the inkjet printing apparatus of FIG. 1 in which the print head contacts to a cap.
Figure 5:
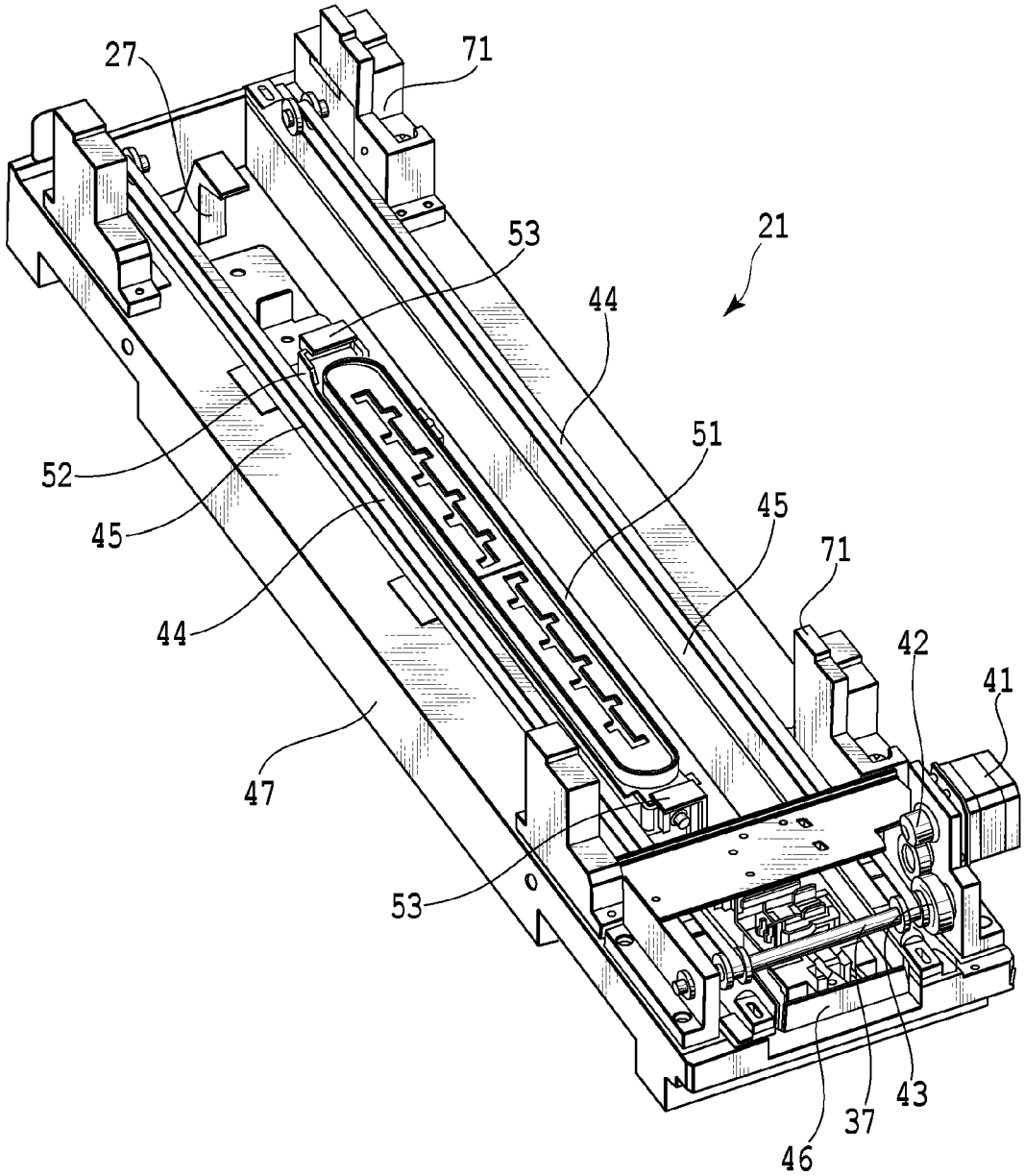
FIG. 5 is a perspective view illustrating a cleaning mechanism that performs the recovery operation of the print head of the inkjet printing apparatus of FIG. 1 in which the print head is separated from the cap and the print head is not attached to the cap.

FIG. 4 and FIG. 5 are a perspective view illustrating the detailed configuration of the cleaning mechanism 21. FIG. 4 illustrates the state (during a recovery operation) in which the cleaning mechanism 21 has thereon the print head 14. FIG. 5 illustrates the state in which no print head is provided on the cleaning mechanism 21. The cleaning mechanism 21 includes a cap 51 and a positioning member 71. When the print head 14 is subjected to a recovery operation, the print head 14 is moved to a position corresponding to the cleaning mechanism 21 and is subjected to a recovery operation in order to maintain the favorable ink ejection state from the ejection port of the print head 14.

The cleaning mechanism 21 includes: a suction wiper unit (recovery unit, suction unit) 46 for removing the matter attached to the ejection port face of the print head 14; a movement mechanism for moving the suction wiper unit 46 along the wiping direction; and a frame 47 for supporting these members in an integrated manner. The suction wiper unit 46 is a movable unit having two suction ports (which will be described later). The suction wiper unit 46 performs, when dust (e.g., paper dust) exists in an ejection port formation portion in which an ejection port is formed in the print head, a recovery operation by wiping the dust while sucking the dust. The movement mechanism is driven by a driving source to move the suction wiper unit 46 guided and supported by two shafts 45 in a direction along which the ejection port array extend. The driving source has a driving motor 41 and reduction gears 42 and 43 and rotates the drive shaft 37. The rotation of the drive shaft 37 is transmitted by the belt 44 and a pulley to thereby move the suction wiper unit 46. The suction wiper unit 46 operates, as will be described later, to suck the matter attached to the ejection port face of the print head 14 through the suction port and simultaneously wipes the print head 14 to thereby remove the attached matter.

In FIG. 5, the cap 51 is retained by a cap holder 52. The cap holder 52 is biased by a spring in a direction vertical to the ejection port face of the print head 14 and can move against the spring. While the frame 47 being at the capped position, the print head 14 moves in the direction vertical to the ejection port face to be contacted to and is separated from the cap 51. By capping the ejection port face by allowing the cap 51 to be contacted to the ejection port face of the print head, the ejection port is suppressed from drying.

Figure 6:
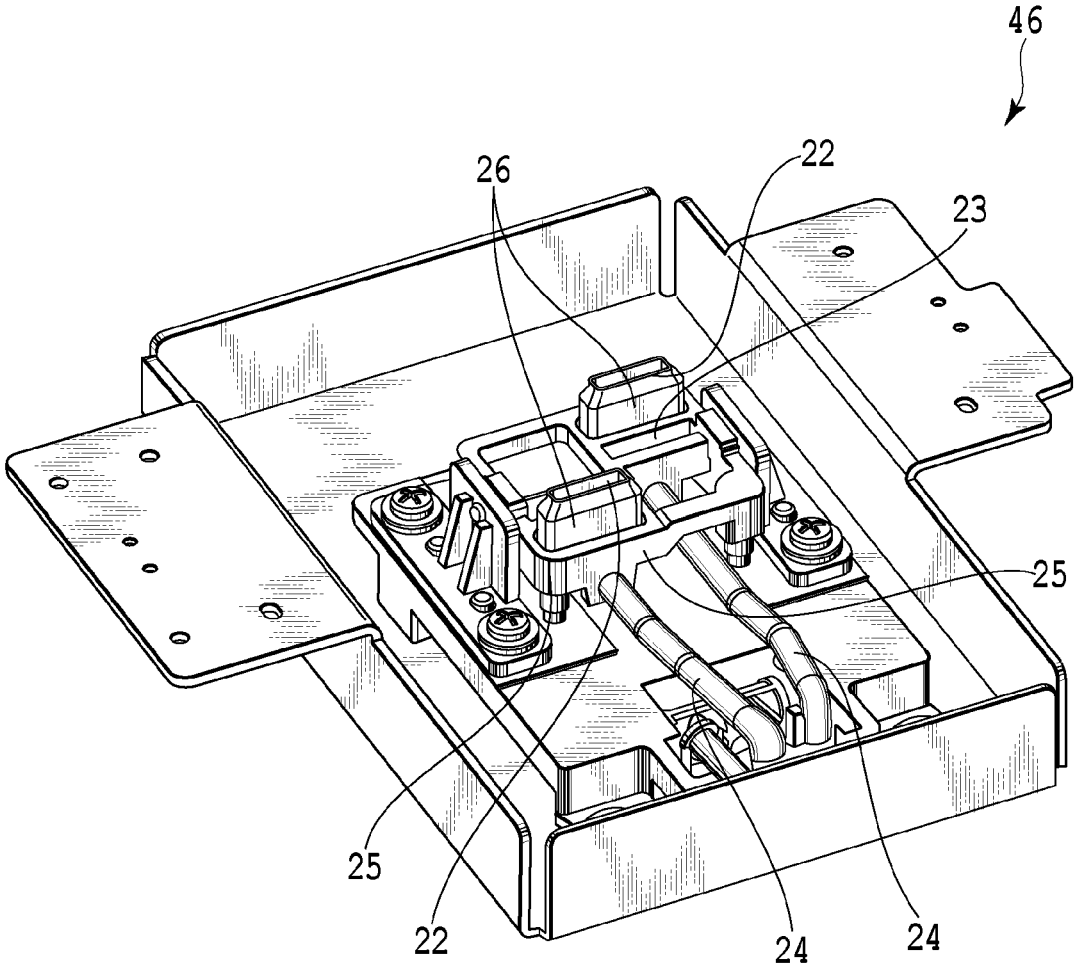
FIG. 6 is an expanded perspective view illustrating a suction wiper unit of the cleaning mechanism of FIG. 4 and FIG. 5.

The positioning member 71 operates, during the recovery operation and the capping, to be contacted to the print head-side positioning member provided in the head holder to thereby determine a positional relation between the print head 14 and the cleaning mechanism 21. FIG. 6 is a perspective view illustrating the configuration of the suction wiper unit 46. The suction wiper unit 46 includes two suction ports 22 so as to correspond to two ejection port arrays.

The two suction ports 22 are configured, in the plane including the suction ports 22 and in a direction orthogonal to the scanning direction of the suction wiper unit 46, to have substantially the same interval as the interval between the two ejection port arrays in the print head 14. The two suction ports 22 are also configured, in the scanning direction of the suction wiper unit 46, to have substantially the same gap as the gap (predetermined distance) between the neighboring two chips in the print head 14. The suction port 22 is retained by the suction holder 23. The suction holder 23 is biased by the spring 25 as an elastic body in a direction vertical to the ejection port face of the print head 14. Specifically, the suction portion 26 including the suction port 22 can move against the spring to move in the direction orthogonal to the ejection port face. In other words, the suction holder 23 is supported by a displacement mechanism that can be straightly displaced in the interval direction of the ejection port face and the print medium. This displacement mechanism functions to absorb the motion of the suction portion 26 when the suction portion 26 moves over the chip sealed portion of the print head 14. The two suction ports 22 are connected to tubes 24 via the suction holder 23. The tubes 24 are connected to a negative pressure generation unit such as a suction pump. When the negative pressure generation unit is driven, a negative pressure for sucking ink or dust is given to the interior of the suction port 22.

Figure 7:
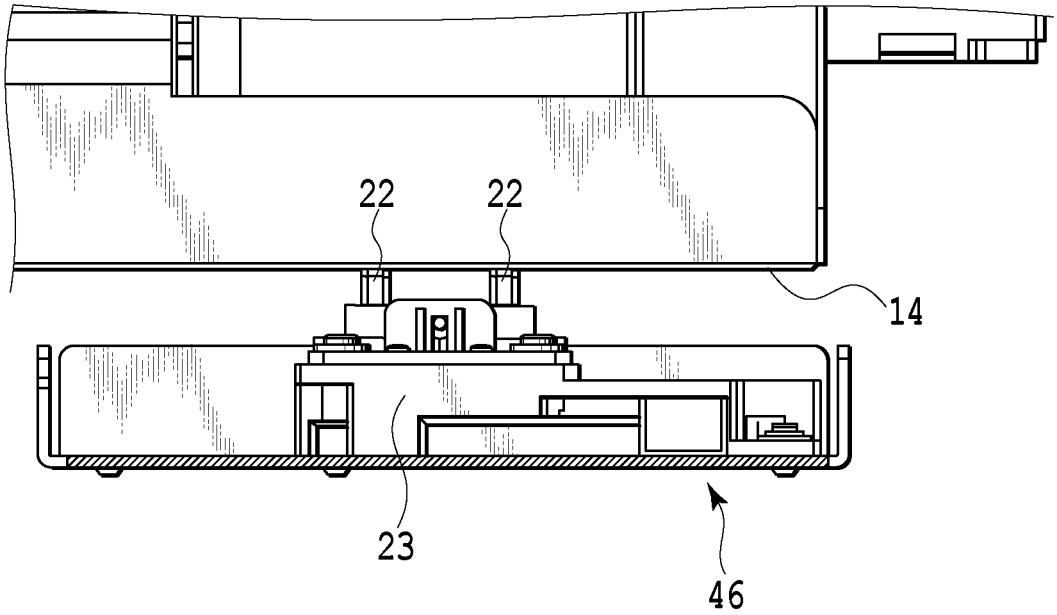
FIG. 7 is a side view illustrating the suction wiper unit of FIG. 6 contacts to the print head.

FIG. 7 is a side view illustrating the recovery operation by the cleaning mechanism. FIG. 7 is a side view illustrating the print head 14 subjected to the recovery operation by the suction port 22. When the recovery operation is carried out, the print head 14 is set at such a position that allows the tip end of the suction portion 26 to be contacted to the ejection port face of the print head 14. The suction wiper unit 46 also functions as a wiping unit to wipe the ejection port formation face of the print head including the ejection port. When the passing number at which the cut part of the sheet passes the printing position 4*b* is equal to or higher than a threshold value, the suction wiper unit 46 wipes the ejection port formation face. When the recovery operation is performed, the suction wiper unit 46 is moved along the direction along which the ejection port array extends while allowing the negative pressure generation unit to generate a negative pressure in the suction port 22. As a result, while using the negative pressure to suck ink or dust attached to the periphery of the ejection port through the suction port 22, the ink or dust can be removed from the print head 14. As described above, the recovery operation is performed by the suction wiper unit 46 in which the suction port 22 is formed that can suck the attached matter by a negative pressure and the suction port 22 can be scanned in the direction along which the ejection port array extends in the print head 14. The suction wiper unit 46 also functions as a suction unit that sucks the matter attached to the ejection port formation face of the print head including the ejection port. When the suction wiper unit 46 has a contact with sealed portion protruding than the ejection port face of the print head 14 in the middle of the movement in the direction along which the ejection port array extends, the suction portion 26 is pushed in a direction orthogonal to the ejection port face. As described above, in the suction wiper unit 46, the suction holder 23 can be displaced in the direction orthogonal to the ejection port face. Thus, even when the suction portion 26 is pushed, the motion thereof can be relieved by the displacement of the suction holder 23.

The recovery operation for removing the dust (e.g., paper dust) attached to the print head is performed, in this embodiment, by performing the suction operation through the suction port 22 and by contacting the suction wiper unit 46 to the print head 14 to perform the wiping by the suction wiper unit 46. However, the present invention is not limited to this. Recovery operations other than the above one also may be performed. For example, instead of performing both of a suction operation and a wiping operation in the recovery operation, only any one of a suction operation and a wiping operation also may be performed. There also may be a possibility where the curl of the sheet causes the sheet to be contacted to the print head and thus the paper dust from the sheet for example is attached to the print head 14. In order to remove the dust (e.g., paper dust) attached to the print head 14 due to the curled sheet as described above, a recovery operation such as a preliminary ejection also may be performed. When the preliminary ejection is performed, the ejection through the ejection port of ink droplets not contributing to the printing operation is performed at the timing of the recovery operation. As a result, the dust (e.g., paper dust) remaining in the ejection port is removed from the ejection port. The preliminary ejection also may be performed by ejecting ink from the ejection port of the print head 14 to the cap. Alternatively, the preliminary ejection also may be performed by ejecting ink to a position away from the sheet (e.g., a platen, a conveying belt). Alternatively, the recovery operation also may be performed by suction recovery using the suction recovery unit to suck and discharge ink through the ejection port in a forced manner while the ejection port of the print head 14 being covered by a cap. Alternatively, the recovery operation also may be performed by a pressurization recovery to use a pressurization recovery unit to pressurize the ink in the print head to thereby discharge the ink through the ejection port. Other recovery operations also may be performed.

Figure 8:
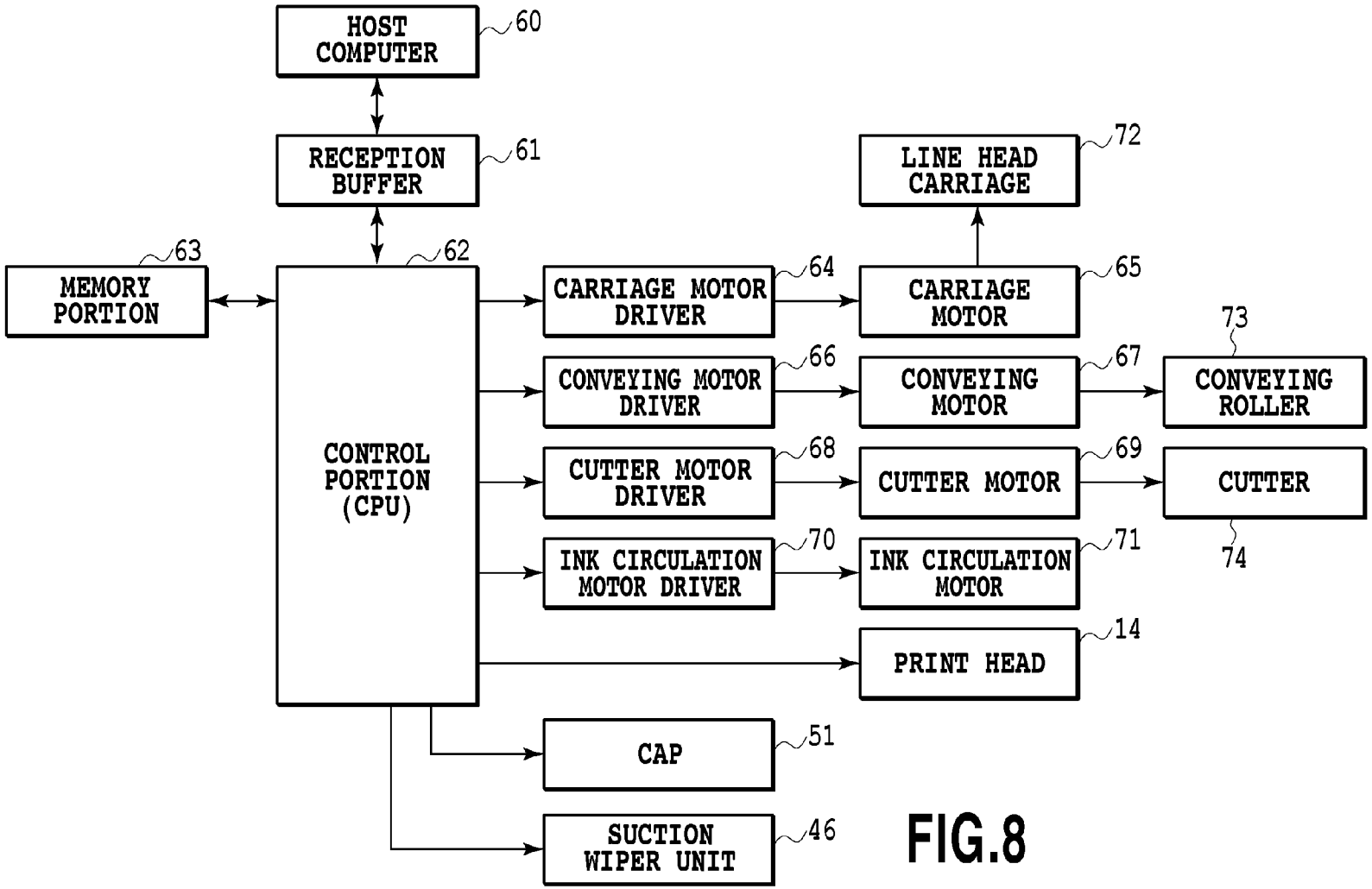
FIG. 8 is a block diagram illustrating the configuration of the control system of the inkjet printing apparatus of FIG. 1.

FIG. 8 illustrates a block diagram illustrating the control system used for the above-described inkjet printing apparatus. The reception buffer 61 of the inkjet printing apparatus 100 receives, from a host computer 60, data for the characters or images to be printed. The host computer 60 receives, from the inkjet printing apparatus 100, data for confirming whether the data is correctly transferred or data showing the operation state of the inkjet printing apparatus 100, and outputs them. The data of the reception buffer 61 is transferred to a memory portion 63 under the control by a control portion (Central Processing Unit (CPU)) 62 and is temporarily stored in a Random Access Memory (RAM).

Upon receiving the instruction from the CPU 62, a carriage motor driver 64 drives a carriage motor 65 to control a line head carriage 72. Based on the instruction from the CPU 62, mechanism portions (mechanical portions) (e.g., the cap 51, the suction wiper unit 46) are driven and the operation thereof is controlled. Based on the instruction from the CPU 62, the conveying motor driver 66 drives a conveying motor 67 and controls the conveying roller 73 for conveying a print medium. Based on the instruction from the CPU 62, a cutter motor driver 68 drives a cutter motor 69 and controls a cutter 74 for cutting the print medium to have a predetermined length. Based on the instruction from the CPU 62, an ink circulation motor driver controls an ink circulation motor 71 for driving a circulation pump or an on-off valve. Based on the instruction from the CPU 62, the print head 14 is driven in a controlled manner to thereby perform the image printing and the preliminary ejection.

Next, the following section will describe a timing at which the print head recovery operation is performed in the inkjet printing apparatus of this embodiment. The inkjet printing apparatus 100 of this embodiment has a rewinding unit for rewinding, after the completion of the printing operation, the tip end of the roll paper (the downstream-side end) from the cutter portion 6 to the roll position S1. By this rewinding unit, whenever a printing step from the start of the printing apparatus to the shut down of the power source of the printing apparatus is performed in the inkjet printing apparatus 100, the rewinding operation is performed to rewind the cut part of the roll paper to the roll position S1 after the printing operation. The rewinding operation allows the cut part at the tip end of the roll paper to pass the printing position 4*b* at which the printing by the ink ejection from the print head is performed. The periphery of the cut part of the roll paper may have dust (e.g., paper dust) attached thereto with a higher possibility than those of other parts. Thus, a risk is caused where, when the cut part passes the printing position 4*b*, the dust (e.g., paper dust) attached to the cut part may be floated and attached to the print head 14. When the dust (e.g., paper dust) is attached to the periphery of the ejection port in the print head 14, the dust undesirably clogs the ejection port, thus causing a risk where the favorable ink ejection cannot be maintained. Even when the dust does not clog the ejection port, another risk is caused where the dust positioned at a part of the ejection port has an influence on the flying direction of the ink droplets, thus causing a declined the landing accuracy of ejected ink. To prevent this, the inkjet printing apparatus 100 of this embodiment performs the recovery operation depending on the number at which the cut part of the roll paper is caused by the rewinding operation to pass the printing position.

Figure 9:
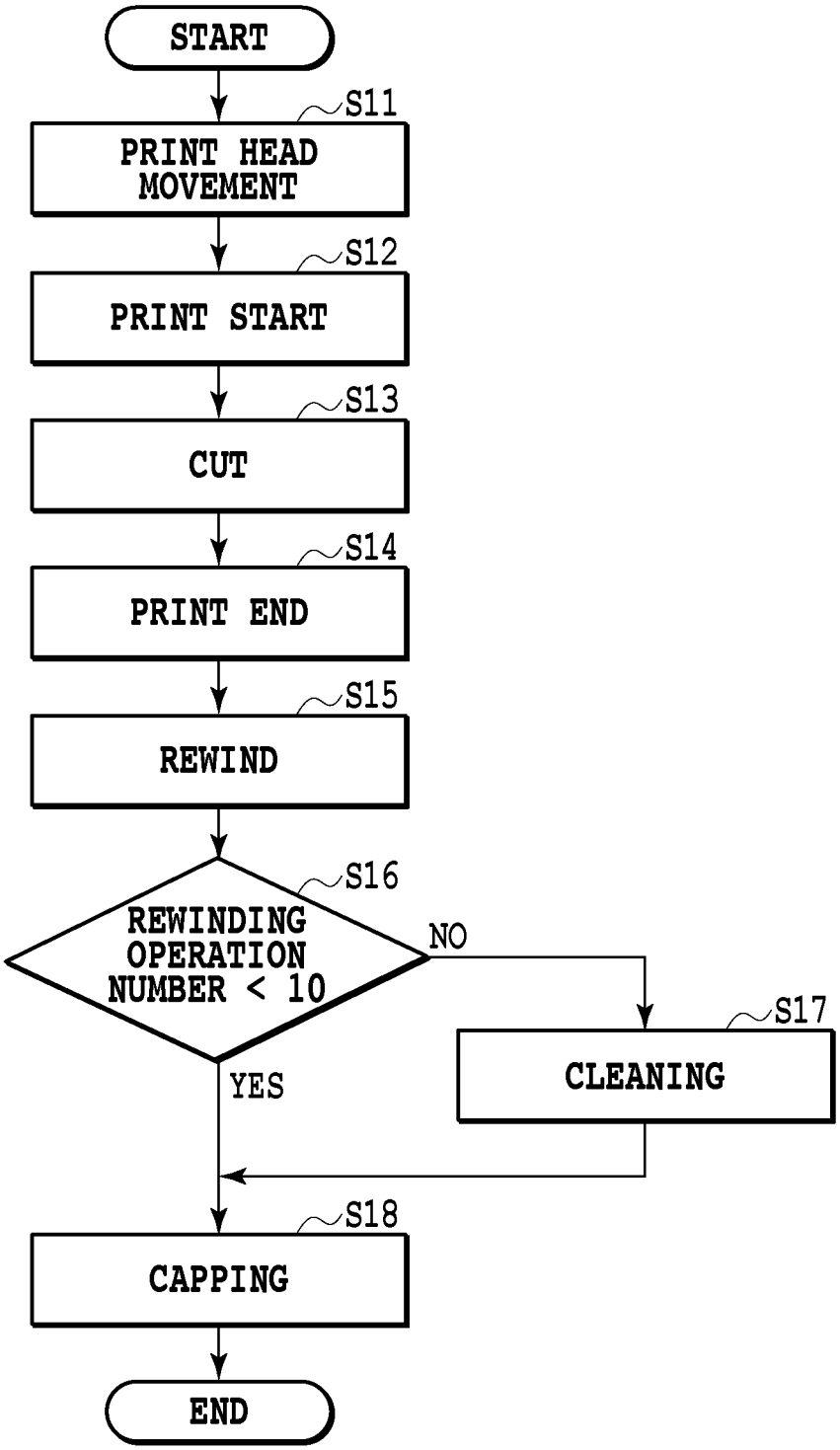
FIG. 9 is a flowchart illustrating the flow of the control of the timing at which the print head recovery operation is performed when the inkjet printing apparatus of FIG. 1 performs the one-side printing.

The following section will describe the print head recovery operation in this embodiment. The print head recovery operation is performed at a predetermined timing when the one-side printing is performed. FIG. 9 is a flowchart used when the timing for performing the recovery operation to the print head 14 is controlled.

First, the printing operation is started upon receiving the printing instruction from an operator. When the printing operation is started, the carriage motor driver 64 drives the line head carriage in S11 to move the print head 14. At the same time, the mechanism portion (mechanical portion) (e.g., the cap and the wiper) is also moved. During this, the print head 14 is moved from the capped position at which the ejection port formation face of the print head is capped by the cap to the printing position at which ink is ejected for printing.

When the print head 14 is moved to the printing position, the image printing by the print head 14 to the print medium is started in S12. During this, the conveying motor driver 66 controls the conveying roller 73 for conveying a sheet to continuously convey the sheet. At the same time, the instruction from the CPU 62 controls the driving of the print head 14.

Then, the print head 14 performs the inter-image preliminary ejection by ejecting the ink droplets not contributing to the printing through the ejection port to a position between printed images printed on a continuously-conveyed sheet. The inter-image preliminary ejection is for the purpose of discharging ink having an increased viscosity existing at the periphery of the ejection port in the print head. The preliminary ejection as described above is desirably performed at each fixed cycle so as to prevent ink having an increased viscosity from being caused at the periphery of the ejection port in the print head. The inter-image preliminary ejection is performed in a period from the completion of the printing to the predetermined printing region to the start of the printing to the next printing region. When a relatively-large printed image is printed however, there may be a case where the printing of the image requires a long time to cause a long interval between inter-image preliminary ejections. Thus, the interval between the inter-image preliminary ejections undesirably exceeds the fixed time, thus causing a possibility of ink having an increased viscosity at the periphery of the ejection port in the print head. To prevent this, when the inter-image preliminary ejection performed between printing operations to a printed image on a predetermined region cannot provide a sufficient frequency of the preliminary ejection, the inter-image preliminary ejection also may be combined with a paper preliminary ejection for subjecting the printed image to an ejection recovery processing. When the preliminary ejection is not required, both of the inter-image preliminary ejection and the paper preliminary ejection also may be omitted.

When an image is printed on a roll paper, the inspection pattern and the image printed on the sheet is optically read. Thereafter, the cutter motor driver 68 in S13 drives the cutter motor 69 based on the instruction from the CPU 62. As a result, the cutter blade is moved to cut the printed roll paper to have a predetermined length (cut step). The cut sheets are directly conveyed and are subjected to a drying step. Then, the sheets are sequentially conveyed into the trays of the sorter portion. The conveying motor driver 66 in S14 controls the conveying motor 67 for conveying the cut sheets. Then, the continuous conveyance of the cut sheets is completed, thereby completing the image printing.

After the series of steps of printing the images, the roll paper extending from the roll position to the cut position is, after being cut, rewinded to the original sheet supply portion 1 in S15 (rewinding operation). Then, in S16, the number of the rewinding operations is counted to determine whether the print head should be subjected to a recovery operation or not. As described above, in this embodiment, the number of the rewinding operations is counted as a number showing an approximate number at which the cut part at the tip end of the roll paper passes the printing position. When the number at which the cut part at the tip end of the print medium passes the printing position during the rewinding operation is equal to or higher than the predetermined threshold value, the printing apparatus is controlled so that the print head is subjected to the recovery operation in S17. In this embodiment, the threshold value for the number of the rewinding operations is set to 10. In the recovery operation, in order to remove the paper dust attached to the ejection port of the print head, the suction wiper is used to wipe the part including the ejection port while sucking the part.

As described above, when the number of the rewinding operations is equal to or higher than the predetermined threshold value, the print head 14 is subjected to the recovery operation (recovery step). In this embodiment, the number at which the rewinding operation is performed is used instead of the passing number at which the cut part at the tip end of the roll paper cut by the cutter portion 6 passes the printing position. During this, the CPU 62 functions as a control unit to control the suction wiper unit 46 so that the print head 14 is subjected to the recovery operation. The count number at which the rewinding operation is performed is reset to zero whenever the count number is equal to or higher than the threshold value. Specifically, the count value of the passing number is reset to zero whenever the count value is equal to or higher than the threshold value.

In this embodiment, when the number at which the rewinding operation is performed is equal to or higher than the threshold value, the recovery operation is performed. During the rewinding operation, the tip end of the sheet in the direction B1 returned to the sheet supply portion 1 passes the printing position 4*b* and also passes the printing position 4*b* when the sheet is subsequently supplied in the direction B1 in order to perform the printing again. Thus, one rewinding operation actually means that the cut part of the sheet passes the printing position 4*b* two times. Thus, a configuration may be used where, whenever the rewinding operation is performed one time, two passing numbers are counted and the actual passing number for the printing position 4*b* at which the tip end of the sheet in the direction B1 passes the printing position 4*b* is compared with the threshold value. As described above, the number at which the cut part of the sheet actually passes the printing position 4*b* may be counted, and the recovery operation may be performed based on the count number. As described above, the passing number showing the number at which the cut part of the sheet passes the printing position 4*b* also may be counted so as to include the number at which the cut part of the sheet passes the printing position 4*b* when the sheet is supplied in the direction B1.

During the rewinding operation, the tip end of cut sheet remaining in the direction B1 on the inspection portion 5, the printing portion 4, the positional deviation correction portion 3, and the decal portion 2 passes the printing position 4*b* under the conditions under which a short time has passed since the sheet cutting operation. Thus, there is a possibility where a relatively-high amount of paper dust is attached to the print head 14. Thus, the sheet passing the printing position 4*b* immediately after the rewinding operation may be a problem. Thus, if the sheet passing the printing position 4*b* immediately after the rewinding operation is a problem in particular, only the number of the rewinding operation may be counted and the recovery operation may be performed based on the count value.

In S18, the carriage motor driver 64 drives the mechanism portion (mechanical portion) 65 (e.g., a line head carriage, a cap, and a wiper) to move the print head 14 after the printing or recovery operation from the printing position to the capped position. Then, the series of printing operations are completed.

As described above, this embodiment pays attention on the number at which the cut part at the tip end of the roll paper passes the printing position. The timing of the recovery operation is controlled so as to be performed when the above number is equal to or higher than the threshold value. This can consequently suppress the situation where paper dust attached to the periphery of the ejection port in the print head 14 clogs the ejection port. This can consequently suppress the situation where the dust (e.g., paper dust) attached to the periphery of the ejection port causes a printed image having a deteriorated quality, thereby maintaining the printed image to have a high quality. Since a printed image having a deteriorated quality due to the dust (e.g., paper dust) attached to the print head 14 can be suppressed, a situation can be suppressed where a subsequent optical detection of the printed image shows that the quality of the printed image does not reach a fixed level. This can consequently suppress the situation where the quality of the printed image is determined as not reaching a fixed level leads to the disposal of the printed matter. Thus, the amount of the disposal of such sheets can be suppressed, thus consequently suppress the amount of paper dust.

(Second Embodiment)

Next, the following section will describe the second embodiment of the present invention. It is noted that the same parts as those of the first embodiment are denoted with the same reference numerals and only different parts will be described. The second embodiment is different from the first embodiment in that the inkjet printing apparatus 100 performs a double-side printing. The following section will describe the timing of the print head recovery operation that is performed when the inkjet printing apparatus 100 performs the double-side printing.

Figure 10:
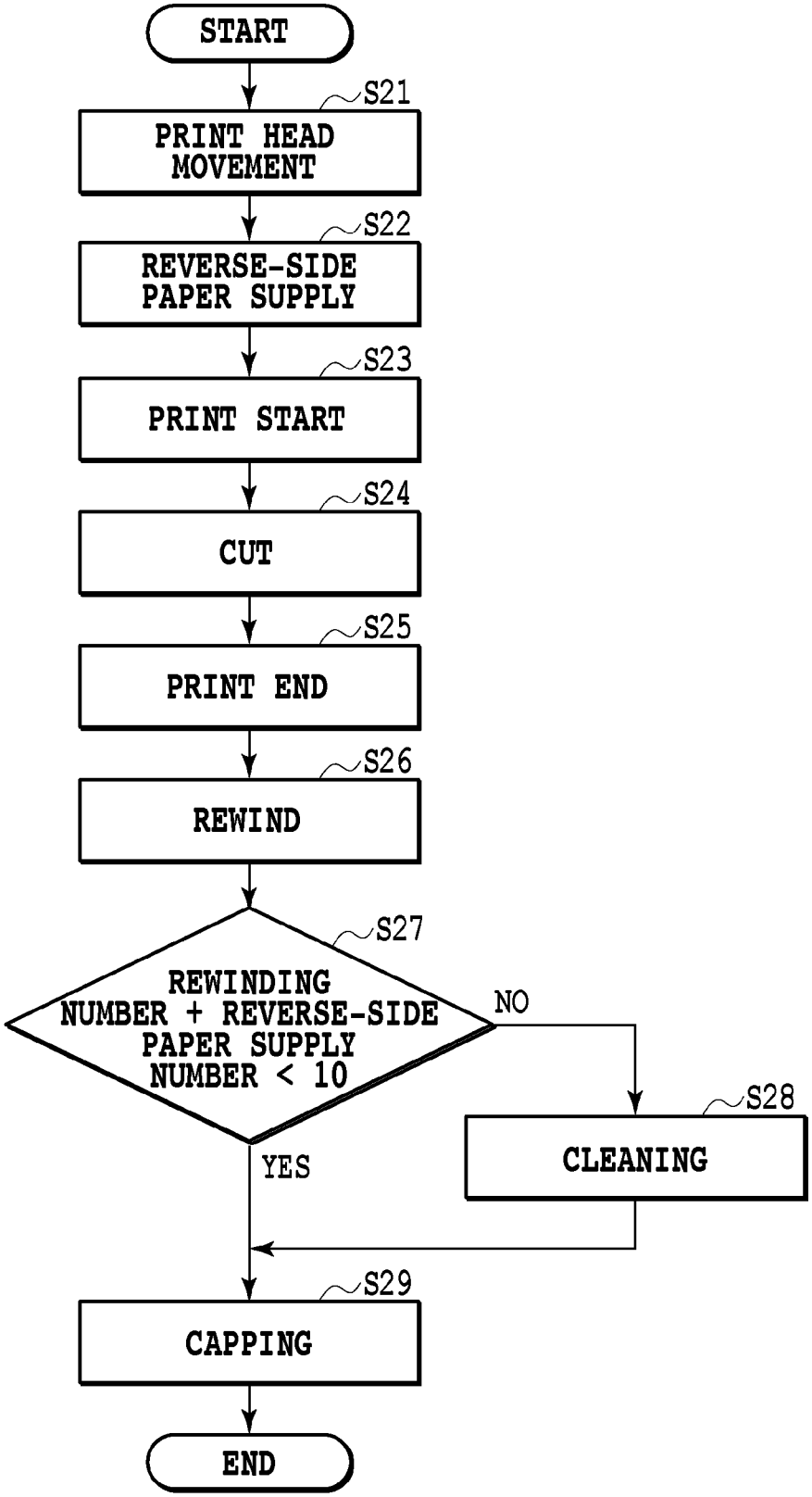
FIG. 10 is a flowchart illustrating the flow of the control of the timing at which the print head recovery operation is performed when an inkjet printing apparatus according to the second embodiment of the present invention performs a double-side printing in the reverse-side printing.

FIG. 10 is a flowchart showing the timing at which the print head 14 is subjected to the recovery operation when the reverse-side is printed in the double-side printing. The timing for the top-side printing is the same as that in the first embodiment and thus will not be described further. Thus, the flowchart in FIG. 10 is started from the timing after the completion of the top-side printing and at the start of the reverse-side printing.

In the double-side printing, the top face is firstly printed. The recovery operation of the print head 14 in the top face printing was already described in the first embodiment. However, the reverse-side printing is impossible if the roll paper continues from the rolls R1 and R2 provided at the roll position. Thus, in the top face printing, the roll paper is cut upon completing the printing on the printed image regions on the top face corresponding to a predetermined number of cut sheets. Thereafter, the continuous sheet is once conveyed along the conveying path L3 in the direction C in preparation for the reverse-side printing and is winded by the sheet winder 9. Then, the top side and the back side of the continuous sheet as well as the tip end and the rear end are switched to invert the continuous sheet. Then, the inverted continuous sheet is conveyed to the printing position 4*b* opposed to the print head 14.

Thereafter, the reverse-side printing is started in S21. Then, the carriage motor driver 64 drives the line head carriage and the CPU 62 drives the mechanism portion (mechanical portion) (e.g., a cap and a wiper) to move the print head 14 from the capped position to the printing position. In order to start the reverse-side printing in S22, the continuous sheet after the top-side printing is supplied to the position just before the print head. In S23, based on the instruction from the CPU 62, the print head 14 is controlled and driven to thereby perform the image printing. The continuous sheet is already subjected to the top-side printing and the tip end of the continuous sheet is cut at the final stage of the top-side printing. Thus, the tip end of the continuous sheet at the front side in the conveying direction is also a cut part of the print medium. Thus, the number of paper supplies during the reverse-side printing is counted as the number at which the sheet passes the printing position. The continuous sheet inverted in order to perform the reverse-side printing must be supplied to the printing position 4*b*. Thus, the sheet remaining at the printing position 4*b*-side is rewinded to the sheet supply portion 1 after cutting operation of the sheet. During this, the cut part of the sheet also passes the printing position 4*b*.

When the image is printed on the reverse side, the inspection pattern and the image printed on the sheet are optically read. Thereafter, the printed continuous sheet is cut to individual cut sheets in S24. As described above, when the reverse-side printing is performed, the continuous sheet is cut at regions corresponding to a predetermined number of cut sheets to thereby provide the individual cut sheets.

When the continuous sheet is again supplied to the printing position 4*b* during the sheet rewinding operation and the reverse-side printing, paper dust caused at the cutting process may be attached to the cut part of the sheet.

The cut sheets are not conveyed to the sheet winder 9 and are dried. Then, the cut sheets are sequentially conveyed along the conveying path E into the trays of the sorter portion. In S25, the conveying motor driver 66 controls the conveying motor 67 for conveying sheets to complete the sheet conveyance. Then, the printing apparatus completes the image printing.

When the printing of the fixed printed image is completed and the printing step is completed, the continuous sheet is cut in S26. Then, any sheet remaining on the inspection portion 5, the printing portion 4, the positional deviation correction portion 3, and the decal portion 2 is rewinded to the sheet supply portion 1. During this rewinding operation, the end of the sheet having passed the printing position just below the print head 14 may cause the paper dust attached to the sheet to be floated, thus resulting in the paper dust attached to the periphery of the ejection port of the print head 14. Thus, the sum of the count number of the rewinding operation and the count number of the reverse-side paper supply is calculated in S27.

As described above, in this embodiment, instead of the number at which the cut part of the sheet passes the printing position 4*b*, the sum of the number of the rewinding operation and the number of the reverse-side paper supply is used. By comparing the sum of the number of the rewinding operation and the number of the reverse-side paper supply with a predetermined threshold value, whether the print head should be subjected to the recovery operation is determined. Specifically, the passing number also includes the number at which the cut part of the sheet passes the printing position 4*b* when the sheet is supplied by the sheet winder 9 to the printing position 4*b*. Thus, the inkjet printing apparatus 100 is controlled so that the recovery operation is performed based on the number at which the cut part of the roll paper passes the printing position. When the sum of the count number of the rewinding operation and the count number of the reverse-side paper supply is equal to or higher than the threshold value, the print head is subjected to the recovery operation in S28. In this embodiment, the threshold value for the sum of the count number of the rewinding operation and the count number of the reverse-side paper supply is set to 10. In the recovery operation, the paper dust attached to the periphery of the ejection port of the print head 14 is removed by wiping the periphery while allowing the suction wiper unit 46 to suck the periphery. Then, in S29, the carriage motor driver 64 drives the line head carriage to move the print head 14 after the printing or the recovery operation from the printing position to the capped position, thereby completing the series of printing operations.

As described above, when the printing is performed by the double-side printing, the passing number includes the sum of the number of the rewinding operations and the number of paper supplies to the sheet winder 9 for switching the top face and the reverse face of the roll paper for the purpose of performing the reverse-side printing. Thus, the double-side printing is controlled so that the sum of the count number of the rewinding operations and the count number of the paper supplies for the reverse-side printing is compared with the threshold value so that the recovery operation is performed when the sum of the count numbers is equal to or higher than the threshold value.

When the final one sheet is printed in the double-side printing, both of the front side end and the rear side end of the sheet in the conveying direction are the cut part. In this case, the cut part of the sheet passes the printing position two times during the paper supply for one reverse-side printing. Thus, there may be a case where only sum of the rewinding number and the number of the paper supplies for the reverse-side printing is different from the number, as a target, showing how many times the cut part of the sheet has actually passed the printing position. Thus, if the sum of the rewinding number and the number of the paper supplies for the reverse-side printing is different from the number showing how many times the cut part of the sheet has actually passed the printing position, it is prefer to prioritize the number showing how many times the cut part of the sheet has actually passed the printing position. Thus, a configuration may be used where, when the final one sheet is printed in the reverse-side printing, the count number larger than the actual number of the paper supplies for the reverse-side printing is counted. If the sum of the rewinding number and the number of the paper supplies for the reverse-side printing is different from the number showing how many times the cut part of the sheet has actually passed the printing position due to other reasons, the number of the paper supplies for the reverse-side printing also may be corrected. The important thing is that the number at which the cut part of the sheet passes the printing position 4*b* is correctly counted.

(Third Embodiment)

Next, the following section will describe the third embodiment of the present invention. It is noted that the same parts as those of the first embodiment and the second embodiment are denoted with the same reference numerals and only different parts will be described.

Figure 11:
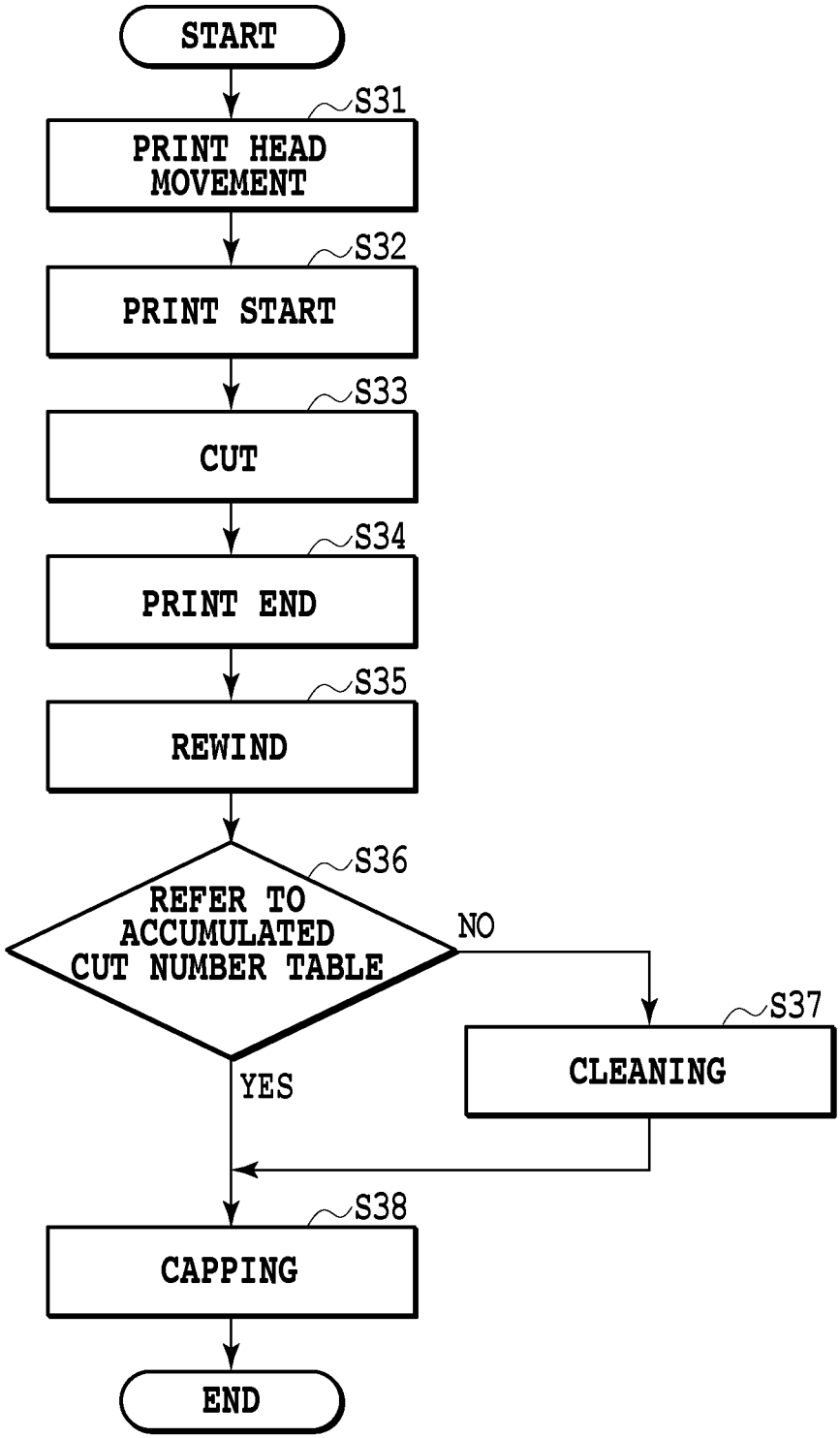
FIG. 11 is a flowchart illustrating the flow of the control of the timing at which the print head recovery operation is performed by an inkjet printing apparatus according to the third embodiment of the present invention.

The third embodiment is different from the first and second embodiments in that when the timing at which the recovery operation is performed is determined, the threshold value of the passing number at which the cut part of the sheet passes the printing position changes depending on the accumulated cut number showing how many times the sheet cutting is performed. The following section will describe the timing at which the print head is subjected to the recovery operation in this embodiment. FIG. 11 is a flowchart that is used to determine the timing at which the print head is subjected to the recovery operation in the third embodiment. First, the printing operation is started upon receiving the printing instruction from an operator. Then, the carriage motor driver 64 drives the line head carriage in S31. The mechanism portion (mechanical portion) (e.g., the cap and the wiper) is driven to move the print head 14 from the capped position to the printing position. In S32, the conveying motor driver 66 controls the conveying roller 73 to convey the continuous sheet. The instruction from the CPU 62 controls and drives the print head 14 to start image printing. After the completion of the printing of the image on the print medium, the inspection pattern and the image printed on the sheet is optically read. Then, the cutter motor driver 68 in S33 drives the cutter motor 69 based on the instruction from the CPU 62. As a result, the cutter is moved to cut the printed sheet to have a predetermined length. During this, paper dust caused during cutting for example may be attached to the cutting part of the cutter. Thus, during the cutting of the sheet by the cutter, there may be a possibility where the paper dust attached to the cutting part of the cutter is accumulated and is moved from the cutting part of the cutter to the sheet. In S34, the conveying motor driver 66 controls the conveying motor 67 for conveying the sheet and completes the sheet conveyance, thereby completing the image printing process.

After the completion of the image printing process, the rewinding operation is performed in which the end of the roll paper sheet not yet printed after the cutting step is returned to the roll position of the roll paper in S35. During this rewinding operation, the sheet passes the printing position at which ink is ejected from the print head. Thus, there may be a case where paper dust attached to the sheet is floated at the printing position and is attached to the periphery of the ejection port of the print head. The paper dust attached to the periphery of the ejection port may have an influence on the ink ejection process, thus causing a deteriorated printing quality.

The amount of the paper dust attached to the print head due to the rewinding operation may be different depending on the accumulated cut number showing how many times the cutting operation is performed after the use of the inkjet printing apparatus. Generally, with an increase of the number at which a cutter cuts a roll paper, the cutter blade becomes dull. Thus, the cutter used to cut many roll papers has a dull blade when compared with the one at the start of the use of the inkjet printing apparatus, which causes a possibility of an increased amount of paper dust caused from the sheet cutting. Specifically, the increased amount of paper dust attached to such a cutter causes an increased amount of paper dust, which causes an increased amount of paper dust attached to the roll paper, thus causing a possibility where an increased amount of paper dust is attached to the print head when the end of the roll paper passes the printing position.

There is another possibility where the dust (e.g., paper dust) attached to the print head is not entirely removed when the print head is subjected to the recovery operation. Thus, as time passes after the start of the use of the inkjet printing apparatus, dust (e.g., paper dust) that could not be removed through the previous print head recovery operations may be accumulated, resulting in an increased amount of dust (e.g., paper dust) attached to the print head.

Due to the reason as described above, even when the number at which the end of the roll paper passes the printing position is the same, the amount of the dust (e.g., paper dust) attached to the print head may be different depending on the accumulated cut number showing how many times the roll paper is cut after the start of the use of the inkjet printing apparatus. To cope with this, an approach may be considered where the recovery operation frequency is changed depending on the accumulated cut number showing how many times the roll paper is cut after the start of the use of the inkjet printing apparatus. Generally, with an increase of the accumulated cut number showing how many times the roll paper is cut after the start of the use of the inkjet printing apparatus, more dust (e.g., paper dust) is attached to the print head 14. Thus, in this embodiment, with an increase of the accumulated cut number showing how many times the roll paper is cut after the start of the use of the inkjet printing apparatus, the threshold value for the passing number is reduced when compared with a case where the accumulated cut number is small. Specifically, the threshold value for the passing number is reduced with an increase of the accumulated passing number. In this manner, the recovery operation frequency is increased with an increased of the accumulated cut number showing how many times the roll paper is cut in the print head 14.

In S36 in the flowchart of FIG. 11, the accumulated cut number showing how many times the roll paper is cut and the number showing how many times the cut part of the roll paper passes the printing position are counted. Then, the count number showing how many times the end of the roll paper passes the printing position is compared with the predetermined threshold value from the table. Whenever the count number showing how many times the end of the roll paper passes the printing position exceeds the threshold value, the print head is subjected to the recovery operation in S37. In this embodiment, the print head 14 is subjected to the recovery operation based on the table shown in FIG. 12. In the table of FIG. 12, the left array shows the accumulated number showing how many times the cutting operation is performed after the start of the use of the cutter in the inkjet printing apparatus. In the table of FIG. 12, the right array shows the threshold value that is determined based on the accumulated number showing how many times the cutting operation is performed and that shows the count value showing how many times the end of the roll paper passes the printing position. The count value showing how many times the end of the roll paper passes the printing position is reset to zero whenever the recovery operation is performed. On the other hand, the value of the accumulated number showing how many times the cutting operation is performed after the start of the use of the inkjet printing apparatus is not reset after the recovery operation. Specifically, as shown in FIG. 12, when the accumulated number showing how many times the cutting operation is performed after the start of the use of the inkjet printing apparatus is within a range from 0 to 10000, the print head is subjected to the recovery operation whenever the number showing how many times the end of the roll paper passes the printing position reaches 100. Thereafter, when the accumulated number showing how many times the cutting operation is performed increases to be within a range from 10000 to 50000 and a range from 50000 to 200000, the recovery operation frequency is increased so as to be performed whenever the number showing how many times the end of the roll paper passes the printing position during the recovery operation reaches 50 and reaches 30. When the accumulated number showing how many times the cutting operation is performed is 200000 or more, then the print head is subjected to the recovery operation whenever the number showing how many times the end of the roll paper passes the printing position reaches 10. In S38, the carriage motor driver 64 drives the line head carriage and the mechanism portion (mechanical portion) (e.g., a cap and a wiper) is driven to move the print head 14 after the printing or the recovery operation from the printing position to the capped position. As a result, the series of printing operations is completed.

As described above, the accumulated number showing how many times the cutting operation is performed after the start of the use of the cutter in the inkjet printing apparatus is high, the recovery operation frequency is increased proportionally. This can consequently suppress the dust (e.g., paper dust) attached to the periphery of the ejection port of the print head 14 in a secure manner, thus suppressing a printed image having a deteriorated quality in a more secure manner.

(Fourth Embodiment)

Next, the following section will describe the fourth embodiment of the present invention. It is noted that the same parts as those of the first embodiment to the third embodiment are denoted with the same reference numerals and only different parts will be described. The fourth embodiment is different from the first embodiment to the third embodiment in that the dot number by the ink ejection is counted and the recovery operation based on the ejected dot number is also performed.

Figure 13:
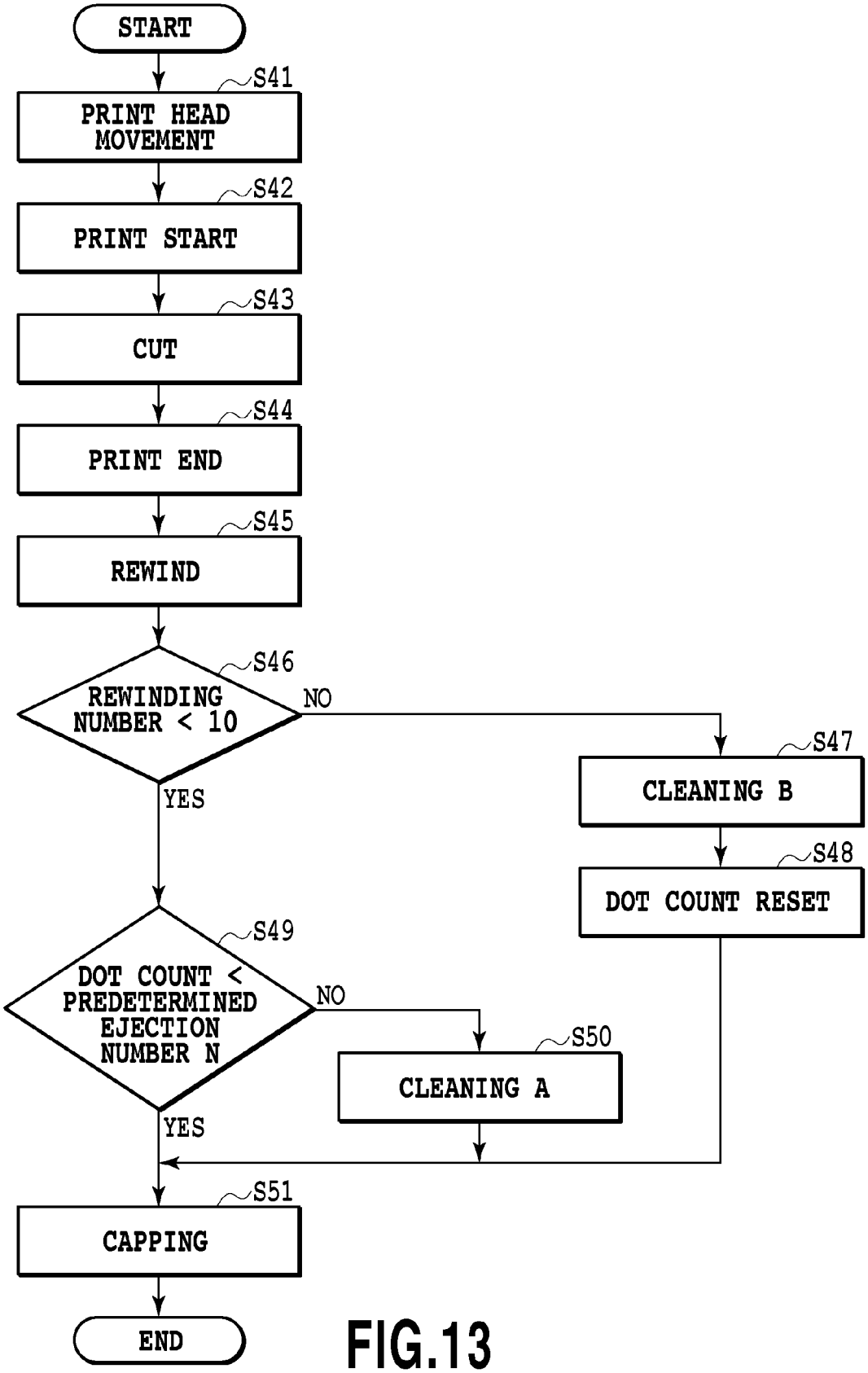
FIG. 13 is a flowchart illustrating the flow of the control of the timing at which the print head recovery operation is performed by an inkjet printing apparatus according to the fourth embodiment of the present invention.

With reference to FIG. 13, the following section will describe the timing at which the print head recovery operation of this embodiment is performed. FIG. 13 is a flowchart used to control the timing at which the print head 14 is subjected to the recovery operation. In this embodiment, the print head 14 is subjected to the recovery operation in order to remove dust (e.g., paper dust) attached to the print head 14. Another recovery operation is also performed to remove solidified ink due to ink attached to the print head 14 (e.g., ink mist). Depending on the purposes of the respective recovery operations, the print head 14 is subjected to the recovery operation using a negative pressure for suction and the scanning speed of the suction wiper unit 46 suitable for the respective recovery operations.

First, the printing operation is started upon receiving the printing instruction from an operator. Then, in S41, the carriage motor driver 64 drives the line head carriage. At the same time, the mechanism portion (mechanical portion) (e.g., the cap and the wiper) is also driven to move the print head 14 from the capped position to the printing position. In S42, the conveying motor driver 66 controls the conveying roller 73 for conveying the continuous sheet. The instruction from the CPU 62 controls and drives the print head 14, thereby starting the image printing.

During printing, ink ejected from the print head 14 may cause, in addition to the main ink droplets used for printing, floating minute ink mist. This ink mist may be attached to the periphery of the ejection port of the print head, thus causing a deteriorated ink ejection performance. To prevent this, the inkjet printing apparatus of this embodiment provides, in addition to the recovery operation for removing dust (e.g., paper dust), another recovery operation for removing the ink mist attached to the print head 14. In the recovery operation for removing the ink mist attached to the print head 14, the inkjet printing apparatus 100 is controlled so that, the number of ink ejections from the ejection port is counted and, the recovery operation is performed when the count value exceeds a predetermined ejection number (threshold value for the ejection number).

When the ink ejection number is counted and the image is printed on the sheet, the inspection pattern and the image printed on the sheet is optically read. Thereafter, in S43, the cutter motor driver 68 drives the cutter motor 69 based on the instruction from the CPU 62 to cut the sheet to have a predetermined length. In S44, the conveying motor driver 66 controls the conveying motor 67 for conveying the sheet to thereby complete the sheet conveyance. Based on the instruction from the CPU 62, the print head 14 is controlled and driven to thereby completing the image printing.

After the completion of the image printing, the continuous sheet extending from the roll position is, after being cut, rewinded to the original sheet supply portion in S45. In S46, the number of the rewinding operations is counted to determine whether the print head 14 should be subjected to the recovery operation or not. When the number at which the cut part of the print medium passes the printing position due to rewinding operation is equal to or higher than the predetermined threshold value, the printing apparatus is controlled to subject the print head 14 to the recovery operation in S47. In the recovery operation, in order to remove the paper dust attached to the ejection port of the print head 14, the periphery of the ejection port is wiped by the suction wiper unit 46 while sucking the periphery of the ejection port.

In the recovery operation for the purpose of removing the paper dust attached to the periphery of the ejection port of the print head 14, the suction is performed by a relatively-high negative pressure. During this, the suction wiper unit 46 is scanned at a relatively-low speed of 0.5 inch/sec in the direction along which the ejection port array extends. As described above, the recovery operation in which the suction is performed by a relatively-high negative pressure and the scanning is performed at a relatively-low speed is assumed as the recovery operation B. The recovery operation B provides a relatively-high suction amount because the suction is performed with a relatively-high negative pressure and the scanning is performed at a relatively-low speed.

In S46, the number at which the cut part of the print medium passes the printing position during the rewinding operation is lower than the predetermined threshold value, the dot count value during the ink ejection for printing is compared with the threshold value for the dot count value in S49. When the dot count value is equal to or higher than the threshold value, the recovery operation A is performed in S50 to remove the ink mist attached to the print head 14.

As described above, in this embodiment, the ink ejection number is counted and when the ejection number is equal to or higher than the predetermined threshold value for the ejection number, the wiper unit 46 is controlled so as to subject the print head 14 to the recovery operation A. During this, the CPU 62 functions as a control unit to control the wiper unit 46. In the recovery operation A, the suction wiper unit 46 is scanned in the direction along which the ejection port array extends at a relatively-high scanning speed of 2.0 inch/sec. Specifically, the scanning speed of the suction wiper unit 46 for performing the recovery operation B is lower than the scanning speed of the suction wiper unit 46 for performing the recovery operation A. Specifically, the wiping speed used when the number at which the cut part of the print medium passes printing position is equal to or higher than the threshold value is lower than the wiping speed used when the ejection number is equal to or higher than the threshold value for the ejection number to allow the suction wiper unit 46 to wipe the ejection port formation face. In the recovery operation A, the suction is performed with a relatively-low negative pressure and thus the suction amount is lower than that in the recovery operation B, thus providing a relatively-weak capability for removing attached matter. Specifically, the negative pressure from the suction port 22 for performing the recovery operation B is higher than the negative pressure from the suction port for performing the recovery operation A. As described above, the suction pressure in the recovery operation when the passing number at which the cut part of the print medium passes printing position 4*b* is equal to or higher than the threshold value is higher than the suction pressure for the recovery operation when the ejection number is equal to or higher than the threshold value for the ejection number. The negative pressure by the suction wiper unit 46 in the recovery operation A is lower than the negative pressure by the suction wiper unit 46 in the recovery operation B. The scanning speed in the recovery operation A is higher than the scanning speed in the recovery operation B. Thus, the recovery operation B can suck more attached matter than the case of the recovery operation A. Thus, the recovery operation B also can function as the recovery operation A. Specifically, the execution of the recovery operation B can mean the execution of the recovery operation A. Thus, the dot count value by the ink ejection is reset in S48 not only when the recovery operation A is performed but also when the recovery operation B is performed.

Thereafter, the carriage motor driver 64 drives the line head carriage and the mechanism portion (mechanical portion) 65 (e.g., a line head carriage, a cap, and a wiper) to thereby completing the printing in S51. Then, the print head 14 after the recovery operation is moved from the printing position to the capped position, thereby completing the printing operation. As described above, in this embodiment, the print head 14 is subjected to the recovery operation for the purpose of removing the dust (e.g., paper dust) attached to the print head 14 and another recovery operation is also performed in order to remove ink mist attached to the print head 14. This can consequently suppress the influence on the ink ejection by the paper dust attached to the periphery of the ejection port of the print head 14 and also can suppress the influence on the ink ejection by the ink mist attached to the periphery of the ejection port. This can consequently suppress a printed image having a deteriorated quality in a more secure manner.

(Other Embodiments)

In this specification, "printing" (or "print") is used to mean to include not only information for forming characters and graphics but also information having a sense or not having a sense. Regardless of whether the information is provided so as to be sensed by humans by the visual perception, the invention is intended to widely cover an image, a design, or a pattern for example formed on a print medium or the processing of a medium.

The term "print medium" (or "sheet") is used to mean to include not only papers generally used in a printing apparatus but also any material that can accept ink (e.g., cloth, a plastic film, a metal plate, glass, ceramics, wood, or leather).

The term "ink" (or "liquid") also should be similarly interpreted to have a wide meaning as in the definition of the "printing" ("print"). The "ink" means, when being placed on a print medium, as liquid to be used for the formation of an image, a design, or a pattern, the processing of a print medium, or the ink processing (e.g., the coagulation or insolubilization of the coloring material in the ink applied to the print medium).

The term "nozzle" is meant to comprehensively include, unless otherwise specified, an ejection port or a liquid path communicating with the ejection port and an element generating the energy used for the ink ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-028479, filed Feb. 14, 2011, which is hereby incorporated by reference herein in its entirety.

What is claimed is:

1. An inkjet printing apparatus comprising:

a conveying unit configured to convey a print medium in a first direction and a second direction opposite to the first direction;

a print head configured to perform a printing operation at a printing position by ejecting ink on the print medium when the print medium is conveyed in the first direction;

a cutter located downstream of the print head in the first direction and configured to cut the print medium;

a count unit configured to count a passing number, the passing number being the number of times that a cut part of the print medium cut by the cutter passes through the printing position when the print medium is conveyed in the second direction;

a recovery unit configured to perform a recovery operation of the print head; and a control unit configured to cause the recovery unit to perform the recovery operation based on the passing number counted by the count unit.

2. The inkjet printing apparatus according to claim 1, wherein the conveying unit is configured to (1) convey the print medium in the first direction to perform a supply operation for supplying the print medium from a supply portion via the printing position to a cutting position at which the print medium is cut by the cutter and (2) convey the print medium in the second direction to perform a return operation for returning the print medium from the cutting position to the supply portion, and the passing number includes the number of times in which the cut part passes the printing position when the print medium is conveyed in the second direction to perform the return operation.

3. The inkjet printing apparatus according to claim 2, wherein the passing number further includes the number of times which the cut part of the print medium passes the printing position when the print medium is conveyed in the first direction to perform the supply operation.

4. The inkjet printing apparatus according to claim 1, wherein the inkjet printing apparatus includes an inversion portion for supplying the print medium to the printing position through the conveying path after being cut by the cutter when a top side and a reverse side of the print medium are inversed, and the passing number further includes the number of times in which another cut part of the print medium passes the printing position when the print medium is supplied by the inversion portion.

5. The inkjet printing apparatus according to claim 1, wherein the control unit makes the recovery unit perform the recovery operation whenever the passing number is equal to or higher than a threshold value.

6. The inkjet printing apparatus according to claim 5, wherein the threshold value is reduced with an increase of accumulation of the passing number.

7. The inkjet printing apparatus according to claim 5, wherein the threshold value is reduced with an increase of the cutting by the cutter of the print medium.

8. The inkjet printing apparatus according to claim 1, wherein the control unit resets the passing number whenever the recovery operation is performed.

9. The inkjet printing apparatus according to claim 1, wherein the recovery unit includes at least one of a wiping unit for wiping an ejection port formation face, at which an ejection port is formed, of the print head, a suction unit for sucking attached matter attached to the ejection port formation face, a preliminary ejection unit for ejecting ink not contributing to image printing through the ejection port, a suction recovery unit for sucking and discharging the ink in the print head through the ejection port, and a pressurization recovery unit for pressurizing the ink in the print head to discharge the ink through the ejection port.

10. The inkjet printing apparatus according to claim 1, wherein the control unit makes the recovery unit perform the recovery operation when the number of ink ejections from the print head is equal to or higher than a predetermined threshold value for the number of ink ejections.

11. The inkjet printing apparatus according to claim 10, wherein the recovery unit is a wiping unit for wiping an ejection port formation face, at which an ejection port is formed, of the print head, and a wiping speed at which the wiping unit wipes the ejection port formation face when the passing number is equal to or higher than a threshold value is slower than a wiping speed at which the wiping unit wipes the ejection port formation face when the number of ink ejections is equal to or higher than the predetermined threshold value for the number of ink ejections.

12. The inkjet printing apparatus according to claim 10, wherein the recovery unit is a suction unit for sucking attached matter attached to an ejection port formation face, at which an ejection port is formed, of the print head, and a suction pressure at which the suction unit sucks the attached matter when the passing number is equal to or higher than a threshold value is higher than a suction pressure at which the suction unit sucks the attached matter when the number of ink ejections is equal to or higher than the predetermined threshold value for the number of ink ejections.

13. The inkjet printing apparatus according to claim 1, wherein the recovery unit constitutes a suction wiper unit that includes (i) a wiping unit for wiping an ejection port formation face, at which an ejection port is formed, of the print head and (ii) a suction unit for sucking attached matter attached to the ejection port formation face, at which the ejection port is formed, of the print head.

14. A print head recovery method in an inkjet printing apparatus including a print head configured to eject ink, the method comprising:

a printing step performing a printing operation at a printing position by the print head on a print medium when the print medium is conveyed in a first direction;

a cutting step cutting the print medium by a cutter located downstream of the print head in the first direction;

a conveying step conveying the print medium in a second direction opposite to the first direction;

a counting step counting a passing number, the passing number being the number of times that a cut part of the print medium cut by the cutter passes through the printing position when the print medium is conveyed in the second direction; and a recovering step recovering the print head based on the passing number counted in the counting step.

* * * * *